US011673763B2

(12) United States Patent
Martinson et al.

(10) Patent No.: US 11,673,763 B2
(45) **Date of Patent: *Jun. 13, 2023**

(54) HOSE-REELING APPARATUS

(71) Applicant: 1246086 Alberta Ltd., Taber (CA)

(72) Inventors: Rory Martinson, Taber (CA); Wade Feist, Coaldale (CA)

(73) Assignee: 1246086 Alberta Ltd., Taber (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/221,551

(22) Filed: Apr. 2, 2021

(65) Prior Publication Data

US 2021/0221641 A1 Jul. 22, 2021

Related U.S. Application Data

(60) Division of application No. 16/713,056, filed on Dec. 13, 2019, now Pat. No. 10,994,965, which is a continuation of application No. 15/406,000, filed on Jan. 13, 2017, now abandoned.

(51) Int. Cl.

| | |
|---|---|
| ***B65H 75/44*** | (2006.01) |
| ***B65H 75/14*** | (2006.01) |
| ***B65H 75/20*** | (2006.01) |
| ***B65H 75/28*** | (2006.01) |

(Continued)

(52) U.S. Cl.

CPC ..... *B65H 75/425* (2013.01); *B65H 49/325* (2013.01); *B65H 75/14* (2013.01); *B65H 75/20* (2013.01); *B65H 75/28* (2013.01); *B65H 75/4402* (2013.01); *B65H 75/446* (2013.01); *B65H 75/4489* (2013.01); *B65H 2701/33* (2013.01); *B65H 2701/332* (2013.01); *B65H 2701/534* (2013.01)

(58) Field of Classification Search

CPC ..... B65H 75/14; B65H 75/20; B65H 75/28; B65H 2701/332

See application file for complete search history.

(56) References Cited

U.S. PATENT DOCUMENTS 3,698,656 A * 10/1972 Ballenger ..... B65H 75/38 242/608.8
4,345,724 A * 8/1982 Lindell ..... B65H 75/22 206/400

(Continued)

*Primary Examiner* — William E Dondero
(74) *Attorney, Agent, or Firm* — Osha Bergman Watanabe & Burton LLP

(57) ABSTRACT

A hosed-reeling apparatus comprising a hose reel and a rack having a front opening for demountably receiving and supporting the hose reel. The hose reel has two sidewalls, a connection member concentrically coupling the two sidewalls, and two spindles extending laterally outward from the centers of the two sidewalls, respectively. The rack has at least a base framework, and a locking structure configurable between an unlock position and a lock position. The base framework has two upward facing channels on opposite sides thereof for demountably receiving the hose reel spindles. The channels are accessible from thereabove when the locking structure is at the unlock position, and the channels are inaccessible from thereabove when the locking structure is at the lock position. Each of the sidewalls of the hose reel may have at least one straight outer edge, allowing the hose reel sit stably on a horizontal surface or a ramp.

7 Claims, 27 Drawing Sheets

(51) Int. Cl.
*B65H 75/42* (2006.01)
*B65H 49/32* (2006.01)

(56) References Cited

U.S. PATENT DOCUMENTS

| | | | | |
|---|---|---|---|---|
| 6,651,926 | B1 * | 11/2003 | Alexander, III | B65H 75/20 242/610.5 |
| 10,994,965 | B2 * | 5/2021 | Martinson | B65H 49/325 |
| 2002/0066821 | A1 * | 6/2002 | Weaver | B65H 75/146 242/604 |
| 2004/0178301 | A1 * | 9/2004 | Wampler | B65H 75/146 242/603 |
| 2016/0159609 | A1 * | 6/2016 | Anderson | B65H 75/14 242/613 |
| 2017/0313542 | A1 * | 11/2017 | Zanetti | B65H 75/20 |
| 2022/0089404 | A1 * | 3/2022 | Gehrke | B65H 75/20 |

* cited by examiner

HOSE-REELING APPARATUS

CROSS-REFERENCE TO RELATED APPLICATIONS

This application is a division of patent application Ser. No. 16/713,056, filed on Dec. 13, 2019, which is a continuation of U.S. patent application Ser. No. 15/406,000, filed on Jan. 13, 2017, the content of each of which is incorporated herein by reference in its entirety.

FIELD OF THE DISCLOSURE

The present disclosure relates generally to a hose-reeling apparatus, and in particular to an apparatus for deploying and retrieving long lengths of industrial hose and/or pipe.

BACKGROUND

Hoses are widely used in agricultural and oil & gas industries for delivering large quantities of fluids, such as water, oil, and the like, from a fluid source to a destination over long distances. Compared to home-use hoses, the hoses used in above-mentioned industries have larger diameters, are much longer, and thus much heavier and difficult to handle.

In above-mentioned industries, fluid-delivery hoses include coilable polymer pipes, coilable metal pipes, and flexible lay-flat hoses. The hoses are usually wound on hose-reeling devices and are shipped to job sites for deployment. In some cases, deployed hoses may be later retrieved back onto hose-reeling devices after the jobs are completed, and redeployed in other locations or alternatively, are stored in a holding facility for future use.

Hose-reeling devices for deploying and retrieving long lengths of industrial and agricultural lay-flat hoses are known. Generally, these devices comprise a rack or supporting structure for demountable engaging and supporting thereon a rotatable reel, onto which a coilable or lay-flat hose is wound. The reel may be rotated manually or automatically by a driving motor in one direction to unwind the hose for deployment, and in the opposite direction to retrieve the deployed hose onto the reel.

In above-mentioned industries, hose-reeling devices are generally of large sizes with heavy weight to accommodate the size, length, and weight of the hoses. Therefore, industrial, and agricultural hose-reeling devices usually comprise suitable support structure such as a stand, to allow the hose-reeling device to steadily and safely sit on a horizontal or near-horizontal surface, for example, a ground terrain surface, a gravel pad, a concrete pad, the platform of a shipping vehicle, and the like, when the hose-reeling device is not in use. Further, self-propelled equipment such as a forklift, a bobcat, a loader, a tractor, a construction vehicle, and the like, is required for transport, deployment, and retrieval of the hose from and onto the hose-reeling device.

The problems with prior-art hose-reeling devices include insufficient protection against risks of injuries or hazards to operators and handlers during hose deployment and retrieval operations, during mounting and demounting engagement of a hose reel by a reel support, also referred to herein as a rack, insufficient strength of the reel and/or rack components to handle the heavy weight of hoses, and lack of a safe and quick way of mounting, dismounting, and transporting reels.

SUMMARY

According to one aspect of this disclosure, there is disclosed a hose-reeling apparatus for deploying and retrieving long lengths of an industrial and/or agricultural hose. The hose-reeling apparatus comprises a reel for receiving thereon and deploying therefrom a hose, for example a lay-flat hose, and a rack for demountable engagement with the reel. The reel generally comprises two matching generally round sidewalls, a connection member concentrically coupling the two sidewalls, and two spindles extending laterally outward from the centers of the two sidewalls, respectively. The rack comprises (i) a three-sided rectangular base framework comprising an upper base frame component and a lower base frame component wherein each of the frame components comprises a matching pair of opposing side rails interconnected by a rear-facing rail wherein the length of rear-facing rail is longer than the lengths of the matching side rails and wherein the upper and lower base frame components are spaced-apart by bracing rails that are integrally engaged to the front and rear corners of the upper and lower base frame components, (ii) an upwardly extending cage framework integrally engaged to the upper surfaces of upper base frame component, and (iii) a pair of locking structures wherein one of the locking structures cooperates with one of the upper side rails and the other of the locking arrangements cooperates with the other of the upper side rails for demountably receiving and rotatably supporting therein the hose reel. Each of the upper side rails of the upper base frame component has an upward-facing channel therethrough for demountably receiving and housing therein a spindle of the reel. The locking structures, when at the unlock position, allow access for the spindles into the channels from thereabove, and when at the locked position, prevents access to or from the channels from thereabove.

In some embodiments, each of the sidewalls of the reel comprises at least one straight outer edge.

In some embodiments, the locking structures comprise two locking arms, each rotatable about a respective pivot on the front support assembly between the lock and unlock positions.

In some embodiments, each locking arm comprises a distal portion for covering the respective channel when the locking arm is at the lock position.

In some embodiments, at least one locking arm further comprises a securing mechanism for securing the locking arm at the lock position.

In some embodiments, the securing mechanism comprises a securing pin.

In some embodiments, the base framework further comprises a coupling structure for demountably engaging the rack to a self-propelled equipment.

In some embodiments, the apparatus further comprises a motor component and a transmission coupled to the motor and the reel for rotating the reel in a first direction for hose deployment and in an opposite direction for hose retrieval. The motor may be a hydraulic motor.

In some embodiments, the apparatus further comprises a controller for controlling the rotation speed of the reel based on a speed of the self-propelled equipment.

DETAILED DESCRIPTION

The embodiments of the present disclosure relate to hose reels and hose-reeling apparatus. The hose-reeling apparatus generally comprises: (i) a reel for winding thereon a flexible hose, and (ii) a rack for demountable engagement with the reel. The hose-reeling apparatus also comprises a hydraulic motor component for cooperating with the hose reel to deploy and retrieve the hose from and onto the hose reel. The hose-reeling apparatus disclosed herein allows quick and safe replacement of the reel, and comprises shielding and barriers for protecting operators from potential injuries.

The hose-reeling apparatus disclosed herein is suitable for deployment of long lengths of hose for transferring fluid such as water over long distances for use in agriculture, water management, and oil and gas industries, among others.

As will be described in more detail below, the rack of the hose-reeling apparatus is configured for demountable engagement and support of the rotatable reel. The hose-reeling apparatus may be coupled to a self-propelled equipment, for example a forklift, a bobcat, a loader, a tractor, a construction vehicle, and the like, for deployment and retrieval of the hose. The reel and rack comprise safety fences for protecting operators from potential injury during transport and operation of the hose-reeling apparatus. However, the safety fences do not block the operator's view during transport and during hose deployment and retrieval operations. The rack also comprises a locking structure for quick and safe reel demounting and replacement. The rack uses rollers for guiding and facilitating hose deployment and retrieval. In one embodiment, the rack comprises a first roller at the top thereof and a second roller at the bottom thereof, allowing the operator to choose to deploy/retrieve the hose from the top of the rack or from the bottom thereof.

The reel comprises two sidewalls concentrically coupled together by a drum or a cage. The sidewalls are made of suitable metal boards, and, compared to the prior art reels with rim and spokes configuration, provide additional protection to operators. Each of the sidewalls has at least one straight outer edge. Thus, when removed from the rack, the reel can stably and safely sit on a substantially leveled or slightly inclined surface without the need of a stand, by placing a straight outer edge of each sidewall in contact with the surface.

Figure 1:
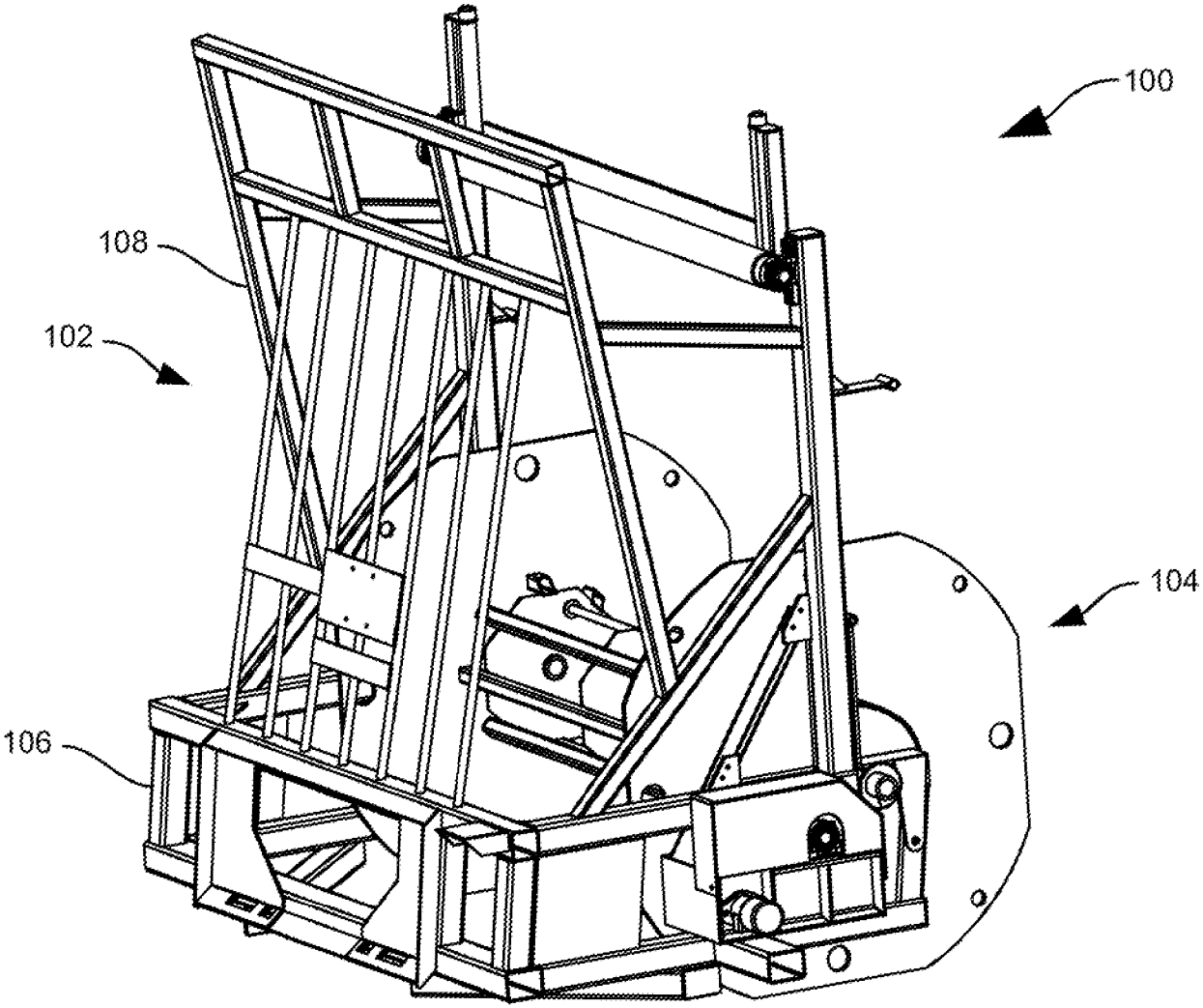
FIG. 1 is a perspective view of a hose-reeling apparatus comprising a rack and a reel, according to one embodiment of the present disclosure.

Turning now to FIG. 1, a hose-reeling apparatus is shown and is generally identified using numeral 100. The hose-reeling apparatus 100 may be coupled to a self-propelled equipment for deploying and retrieving a hose. In this embodiment, the hose-reeling apparatus 100 comprises a rack 102, and a reel 104 that may demountably engage with the rack 102. The reel 104 and the rack 102 have corresponding widths comparable to the width of the self-propelled equipment. In this embodiment, the rack 102 comprises a base framework 106, and a cage framework 108 upwardly extending from the base framework 106.

Figure 2A:
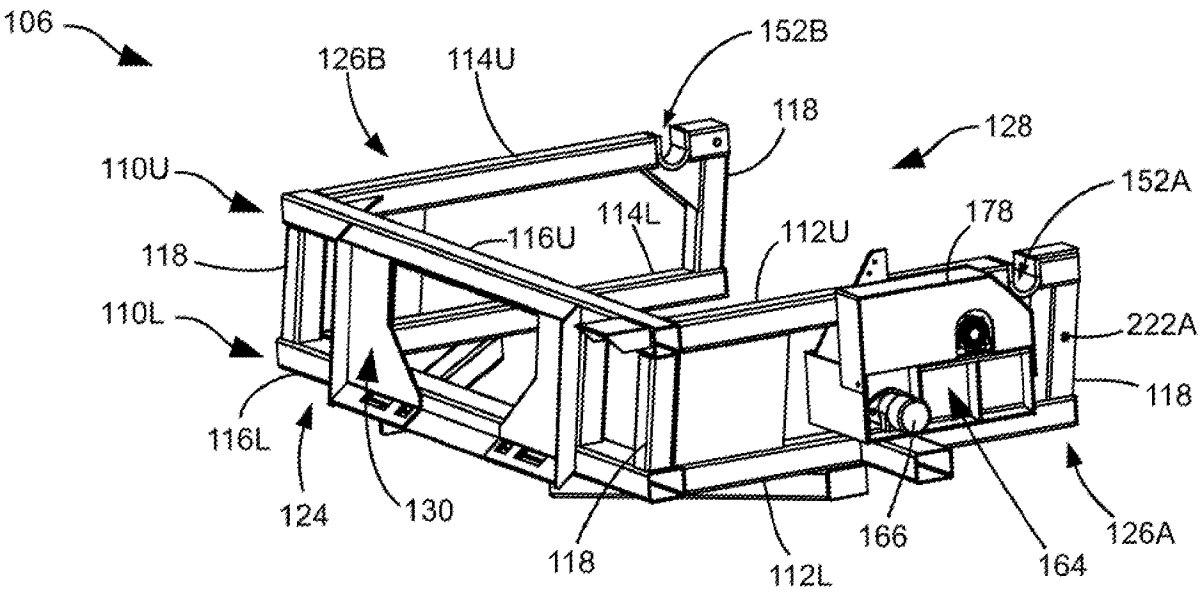
FIGS. 2A and 2B are perspective views from different viewing angles of a base framework of the rack of the hose-reeling apparatus shown in FIG. 1.
Figure 2B:
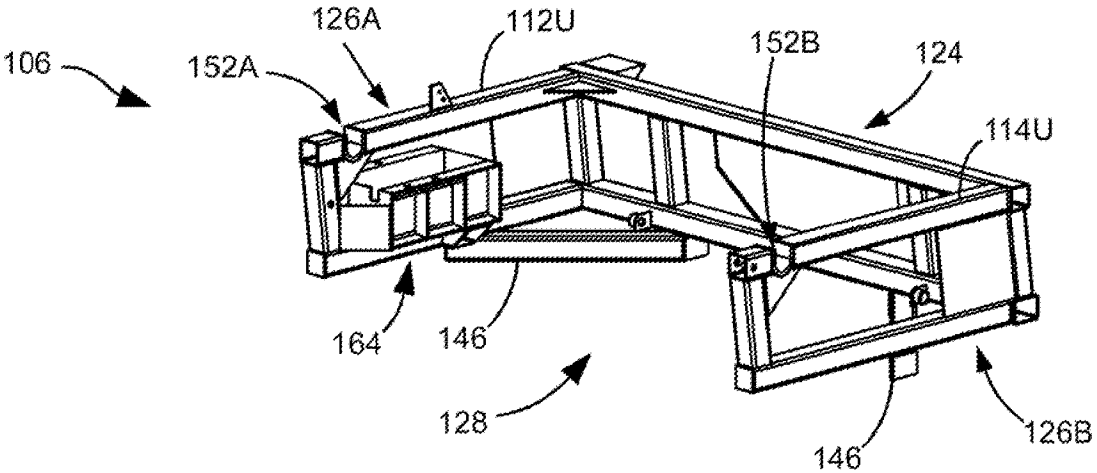

As shown in FIGS. 2A and 2B, the base framework 106 is in a three-sided rectangular shape, and comprises an upper base frame component 110U and a lower base frame component 110L. The upper base frame component 110U comprises a matching pair of opposing upper side rails 112U and 114U interconnected by a rear-facing rail 116U wherein the length of rear-facing rail 116U is longer than the lengths of the matching side rails 112U and 114U. The lower base frame component 110L is general the same as the upper base frame component 110U, and comprises a matching pair of opposing lower side rails 112L and 114L interconnected by a rear-facing rail 116L wherein the length of rear-facing rail 116L is longer than the lengths of the matching side rails 112L and 114L. The upper and lower base frame components 110U and 110L are spaced-apart by bracing rails 118 that are integrally engaged to the front and rear corners of the upper and lower base frame components 110U and 110L. In this embodiment, the rails are square steel tubing/bars.

With this configuration, the upper and lower base frame components 110U and 110L form a rear base frame 124 and two opposing side base frames 126A and 126B coupled to the opposite ends of the rear frame 124, forming a "U" shape with a front opening 128 for receiving the reel (not shown). The base framework 106 also comprises square steel reinforcement bars 146 each coupling the rear frame 124 with a respective side frame 126A, 126B, forming a triangular structure for further strengthening the base framework 106.

The rear frame 124 is formed by the rear-facing rails 116U and 116L spaced-apart and coupled by bracing rails 118. The rear frame 124 comprises a coupling structure 130 for coupling the rack 102 to a self-propelled equipment, such as an agricultural or industrial vehicle, for example a forklift, a bobcat, a loader, a tractor, a construction vehicle, or the like (not shown), for deploying/retrieving the hose.

Figure 2C:
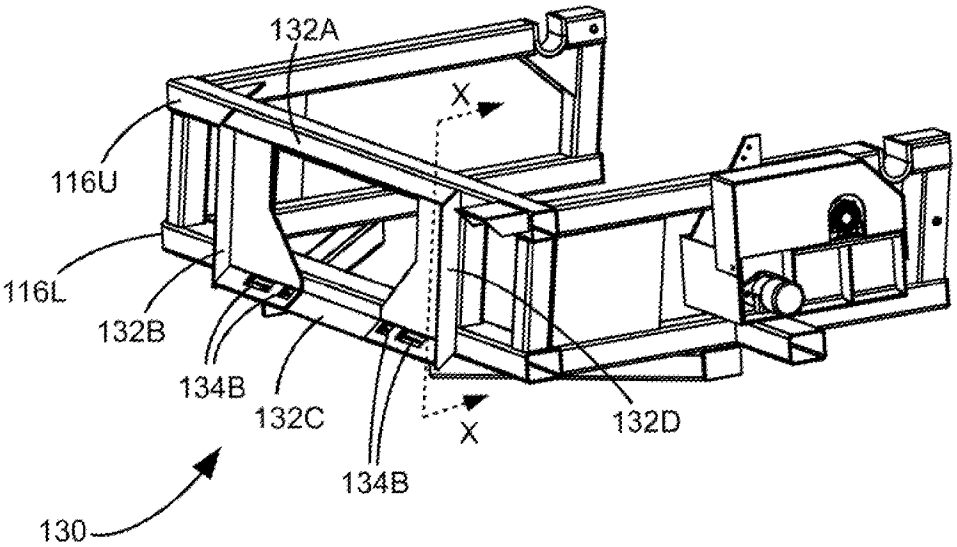
FIGS. 2C and 2D show a coupling structure of the rack shown in FIG. 2A.
Figure 2D:
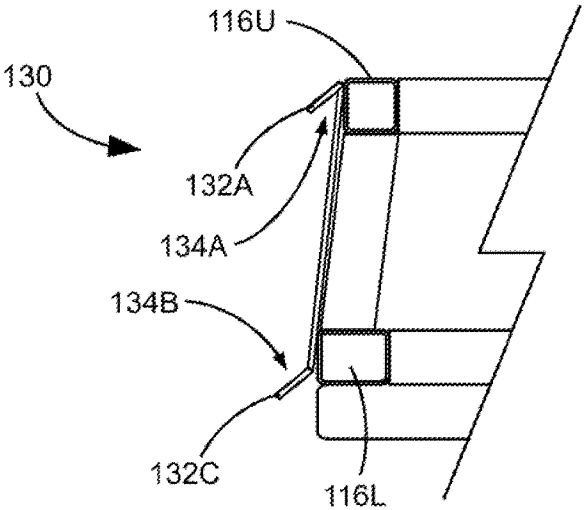

FIGS. 2C and 2D show the detail of the coupling structure 130. As shown, the coupling structure 130 comprises a top wall 132A and a bottom wall 132C extend backwardly and downwardly from the upper and lower, rear-facing rails 116U and 116L, respectively, and two backwardly extending side walls 132B and 132D. The top wall 132A thus form a downwardly facing coupling recess 134A. The bottom wall 132C comprises one or more coupling slots 134B.

Figure 2E:
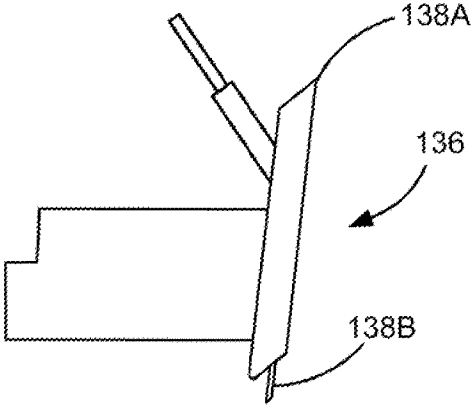
FIG. 2E show a coupling pad mounted on a self-propelled equipment (not shown) for coupling to the coupling structure in FIGS. 2C and 2D.
Figure 3:
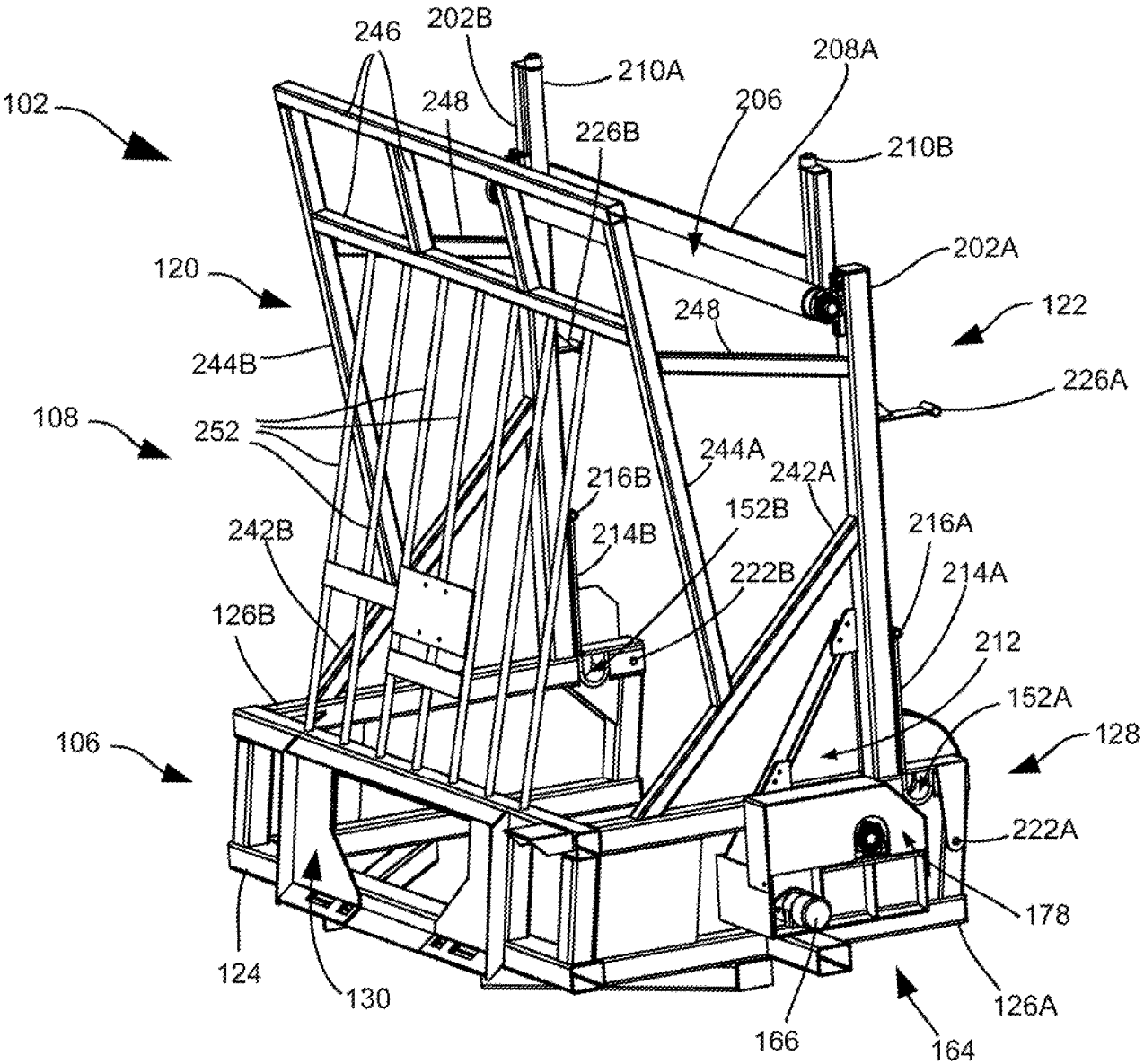
FIG. 3 is a perspective view of the rack of the hose-reeling apparatus shown in FIG. 1, showing the base framework and a cage framework thereof.
Figure 4A:
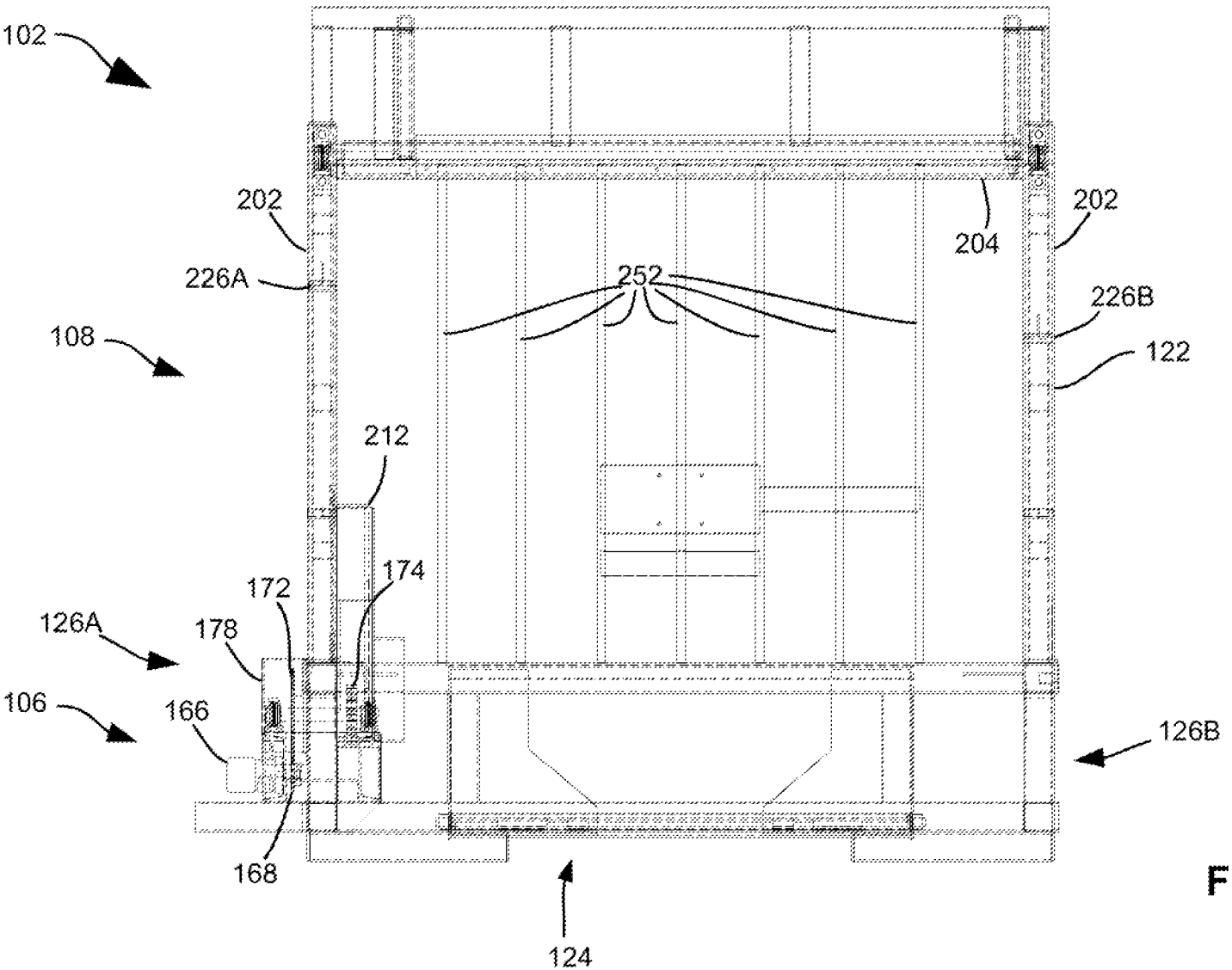
FIG. 4A is a front view of the rack shown in FIG. 3.
Figure 4B:
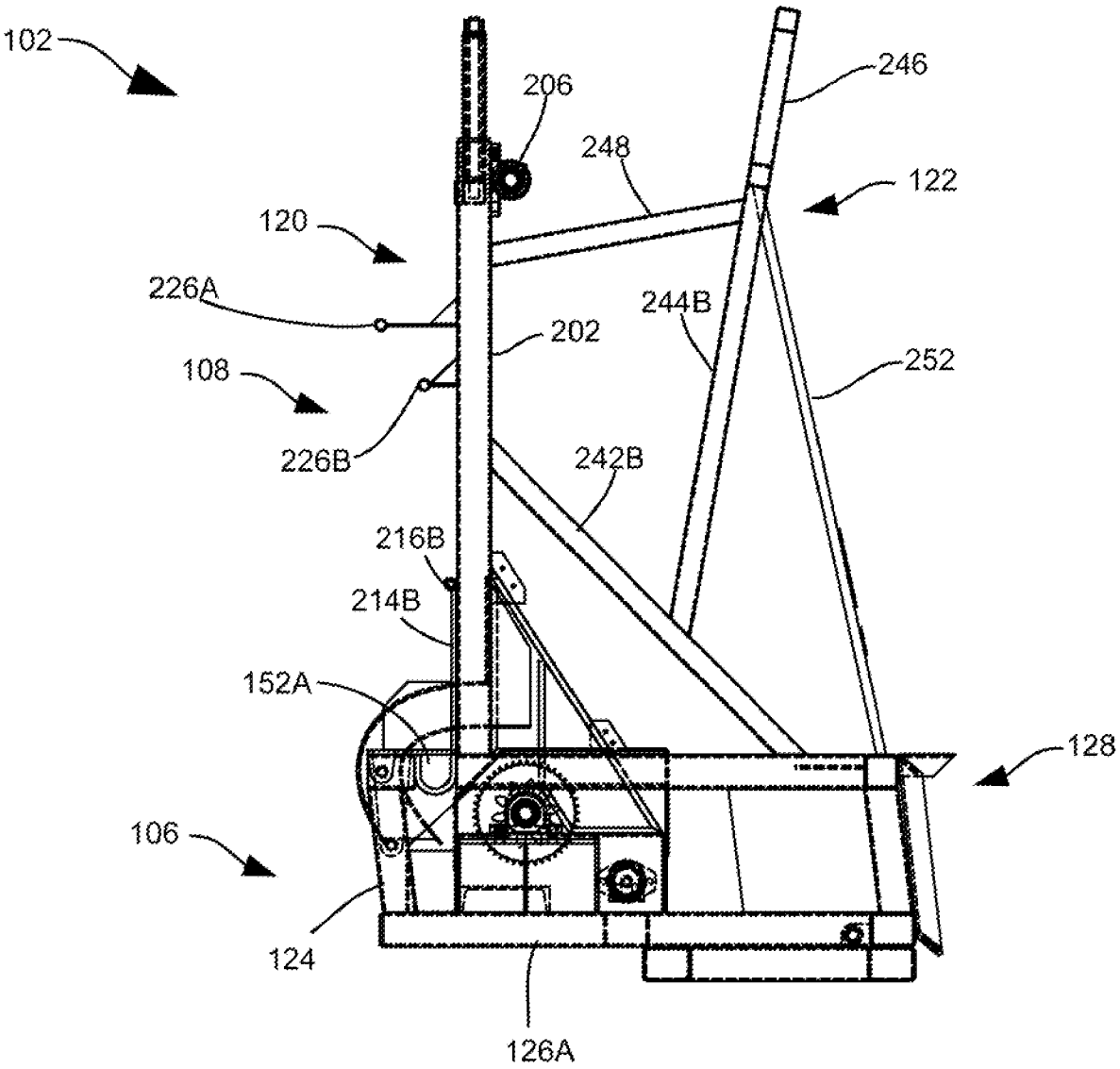
FIG. 4B is a side view of the rack shown in FIG. 3.

FIG. 2E shows a coupling pad 136 mounted on a self-propelled equipment (not shown). As shown, the coupling pad 136 comprises an upwardly extending, top protrusion 138A corresponding to the coupling recess 134A of the coupling structure 130 of the rack 102, and comprises one or more downwardly extending, bottom protrusions 138B corresponding to the coupling slots 134B of the coupling structure 130 of the rack 102.

Referring to FIGS. 2C and 2D, in hose deployment/retrieval, the rack 102 is first coupled to a self-propelled equipment. An operator controls the self-propelled equipment to rotate and move the coupling pad 136 to insert the bottom protrusions 138B of the coupling pad 136 into the coupling slots 134B of the coupling structure 130 of the rack 102. Then, the operator controls the self-propelled equipment to rotate and move the coupling pad 136 to insert the top protrusion 138A of the coupling pad 136 into the coupling recess 134A of the coupling structure 130, and finally slightly shift the coupling pad 136 upward to engage the top protrusion 138A with the top wall 132A of the coupling structure 130.

Referring again to FIGS. 2A, 2B, 3, 4A, 4B and 5, the base framework 106 also comprises a hydraulic motor 166 engaging a transmission assembly 164 mounted on the side base frame 126A. As better shown in FIG. 5, the transmission assembly 164 comprises a driving sprocket 168 mounted on a first shaft 170, and first and second driven sprockets 172 and 174 mounted on a second shaft 176. The hydraulic motor 166 engages the driving sprocket 168 via the first shaft 170, the driving sprocket 168 engages first driven sprocket 172 via an endless chain (not shown), and the second sprocket 174 engages a sprocket of the reel (described later), transferring torque from the hydraulic motor 166 to the reel. The transmission assembly 164 also comprises a cover or housing 178 for enclosing at least a portion of the about described transmission components 168 to 176.

A hydraulic motor controller 400 (see FIGS. 11-15) may be mounted to the rack and in fluid communication with the hydraulic motor 166 for controlling the operation thereof.

Figure 5:
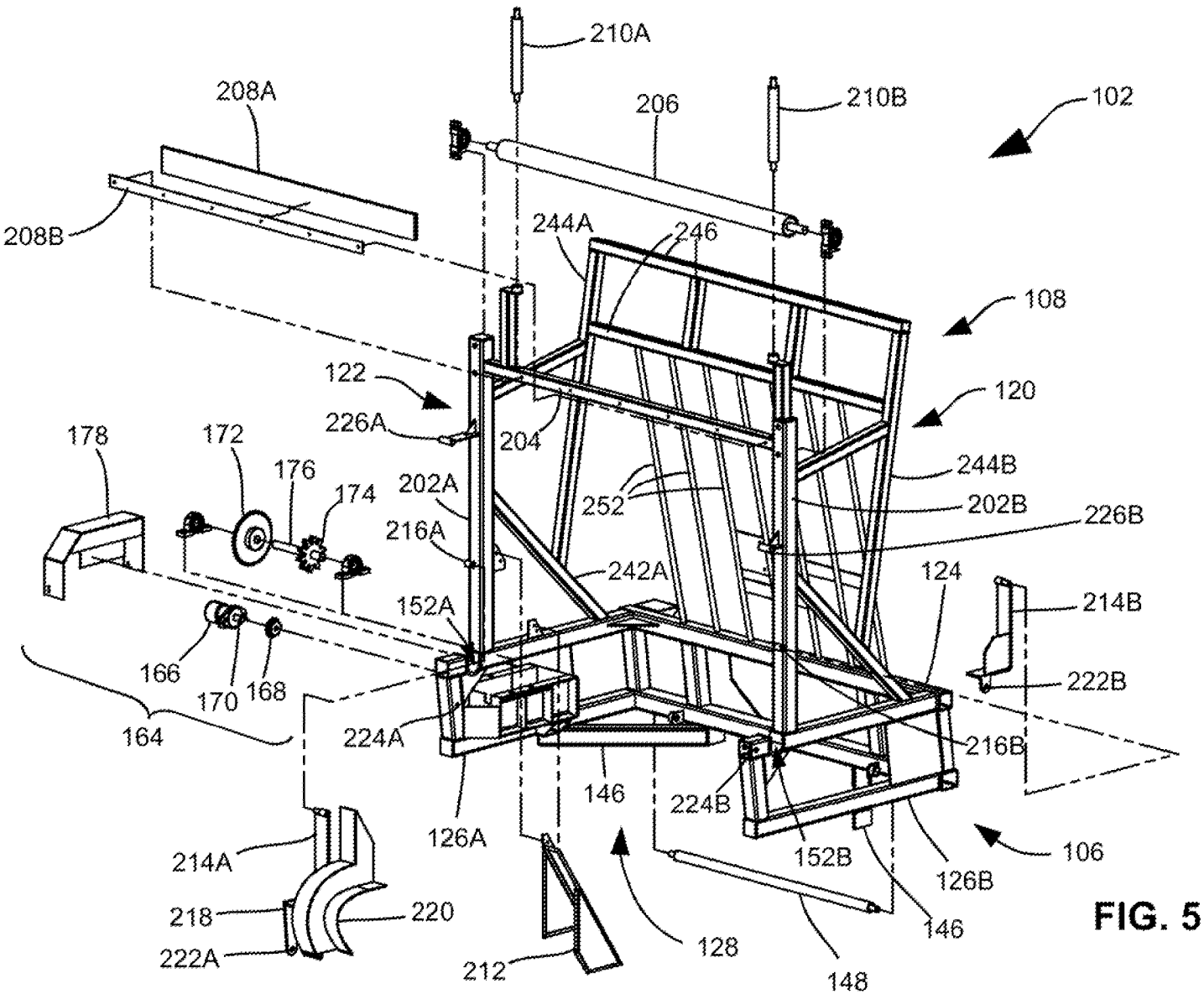
FIG. 5 is an exploded view of the rack shown in FIG. 3.
Figure 6:
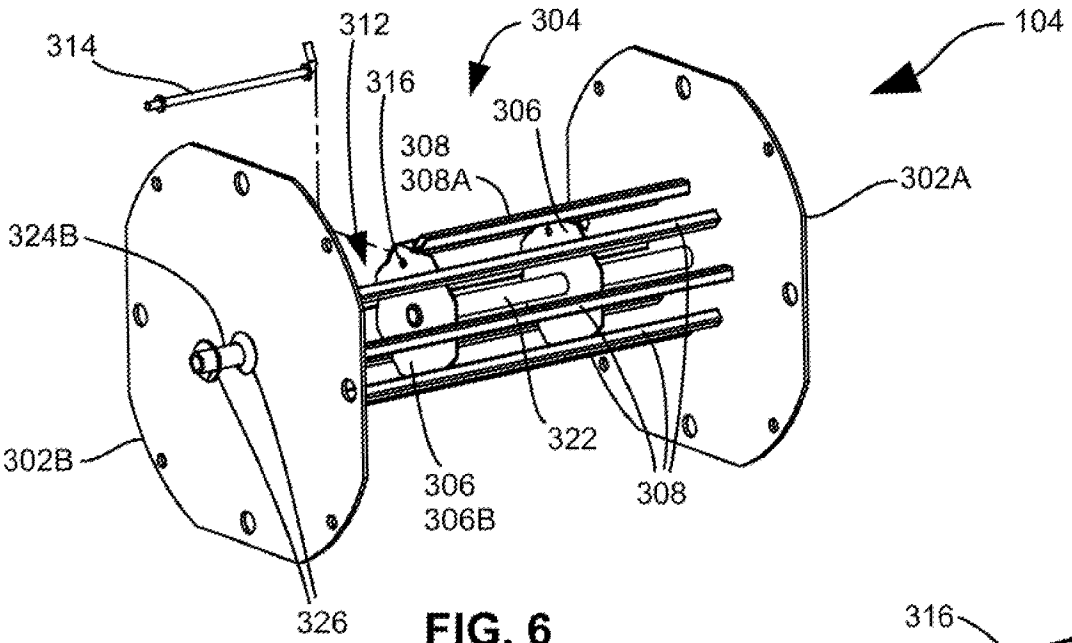
FIG. 6 is a perspective view of a reel of the hose-reeling apparatus shown in FIG. 1.
Figure 7:
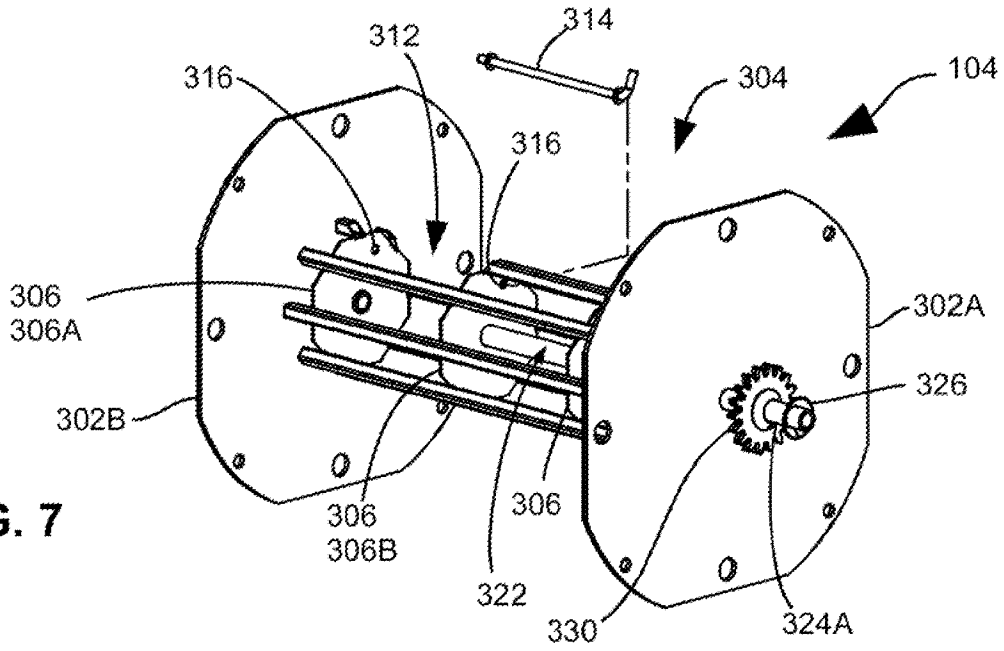
FIG. 7 is a perspective view of the reel shown in FIG. 6, from a different viewing angle.
Figure 8:
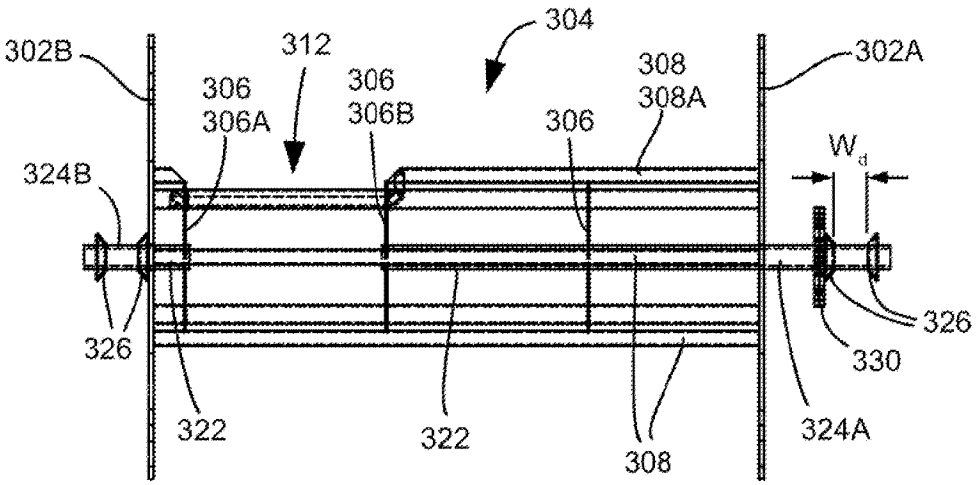
FIG. 8 is a front view of the reel shown in FIG. 6.

As shown in FIG. 5, the rear frame 124 further comprises a bottom roller 148 coupled to the bottom thereof for guiding the hose during hose deployment/retrieval (FIG. 5). Thus, the bottom roller 148 is at an elevation about or below the reel when the reel is installed to the rack.

Each of the side base frames 126A and 126B is formed by the corresponding upper and lower side rails 112U and 112L, or 114U and 114L, spaced-apart and coupled by bracing rails 118. Each of the opposing upper side rails 112U and 114U comprises a channel 152A or 152B at about an upper front end thereof, forming an upward facing recess thereon for receiving spindles of the reel (described later).

Referring to FIGS. 3, 4A, 4B and 5, the cage framework 108 upwardly extends from, and integrally engages to, the upper surfaces of upper base frame component. In particular, the cage framework 108 comprises a rear support assembly 120 and a front support assembly 122. The rear and front support assemblies 120 and 122 are coupled together using triangular structures for reinforcement.

The front support assembly 122 comprises a pair of front support posts 202A and 202B made of square steel tubing. Each of the front support posts 202A and 202B is coupled to a respective side frame 126A or 126B at a location in proximity with a rear side of the respective channel 152A or 152B, and extends therefrom upwardly and slightly backwardly with an inclination angle towards a rear direction. A crossbar 204 is coupled to the posts 202A and 202B about their upper ends for reinforcement.

The front support assembly 122 also comprises a top roller 206 coupled to the posts 202A and 202B about the crossbar 204. A dirt scraper 208A is mounted to the crossbar 204 in proximity with the top roller 206 via a bracket 208B. In hose deployment and retrieval, the dirt scraper 208A scrapes dirt from the hose.

The front support assembly 122 further comprises a pair of vertical side rollers 210A and 210B rotatably mounted about the ends of the top roller 206 for delimiting the hose during hose deployment and retrieval.

At a lower portion of the front support assembly 122, a bracket 212 is coupled to the front support post 202A and the side frame 126A, on an opposite side of the channel 152A, with respect to the front support post 202A, for reinforcement and for shielding the transmission assembly 164.

The front support assembly 122 comprises a locking arm 214A coupled to the front support post 202A rotatable about a pivot 216A thereon. As shown in FIG. 5, the locking arm 214 comprises an "L"-shaped locking portion 218 and a cover portion 220. The locking portion 218 is rotatably coupled to the pivot 216A at a first end to allow the locking arm 214A to rotate upwardly and downwardly about the pivot 216A between an unlock position and a locked position.

In particular, the locking arm 214A may be rotated upwardly about the pivot 216A to the unlock position and removably affixed to a hanger 226A, to open the channel 152A, that is, accessible from thereabove, allowing a reel to be installed to the rack 102. The locking arm 214A may also be rotated downwardly about the pivot 216A to the locked position such that a distal portion of the locking portion 218 engages the side frame 126A of the base framework 106 and closes the channel 152A, that is, inaccessible from thereabove, locking the reel to the rack 102 for use. A securing pin (not shown) may be inserted through a pin hole 222A on the locking arm 214A and a corresponding pin hole 224A on the side frame 126A to secure the locking arm 214A to the side frame 126A about the channel 152A. When the locking arm 214A is at the locked position, the cover portion 220 thereof forms a portion of the housing of the transmission assembly 164.

Similarly, the front support assembly 122 in this embodiment also comprises another "L"-shaped locking arm 214B coupled to the front support post 202B rotatable about a pivot 216B thereon. The locking arm 214B is rotatably coupled to the pivot 216A at a first end to rotate upwardly and downwardly about the pivot 216A between an unlock position and a locked position.

In particular, the locking arm 214B may be rotated upwardly about the pivot 216B to an unlock position and removably affixed to a hanger 226B, to open the channel 152B, allowing a reel to be installed to the rack 102. The locking arm 214B may also be rotated downwardly about the pivot 216B to a locked position such that a distal portion of the locking arm 214B engages the side frame 126B of the base framework 106 and closes the channel 152B, locking the reel to the rack 102 for use. A securing pin (not shown) may be inserted through a pin hole 222B on the locking arm 214B and a corresponding pin hole 224B on the side frame 126B to secure the locking arm 214B to the side frame 126B about the channel 152B.

In this embodiment, the rear support assembly 120 comprises a pair of lower posts 242A and 242B extending upwardly and forwardly from a rear portion of the side frames 126A and 126B, respectively, and coupled to the front posts 202A and 202B at a central portion thereof. The lower posts 242A and 242B then form triangular structures with the front posts 202A and 202B, respectively, for enhanced strength.

The rear support assembly 120 also comprises a pair of upper posts 244A and 244B, extending upwardly and backwardly from a central portion of the respective lower posts 242A and 242B. A crossbar structure 246 is coupled to the upper posts 244A and 244B about their upper ends for reinforcement. The rear support assembly 120 is further coupled to the front support assembly 122 via reinforcement bars 248.

In this embodiment, the rear support assembly 120 further comprises a fence 252 formed by a plurality of metal bars. The fence 252 protects the operator from potential injuries that may be caused by the rotating reel during operation, while still providing reasonably unobstructed view to the operator for monitoring hose deployment/retrieval during operation.

FIGS. 6 to 9 show the structure of the reel 104. The reel 104 comprises a pair of sidewalls 302A and 302B concentrically connected by a lateral connection member 304, which is a cage in this embodiment. The sidewalls 302A and 302B are made of steel board, and are generally of a same shape that comprises at least one straight outer edge. When the sidewalls 302A and 302B are assembled to the cage 304, the corresponding straight outer edges of the sidewalls 302A and 302B are aligned, for example, in a same plane, such that the reel 104 can steadily and safely sit on a generally horizontal platform or on an incline platform, for example, a ramp, with a small inclination angle, by placing a pair of straight outer edges of the sidewalls 302A and 302B in contact with the platform.

Figure 9:
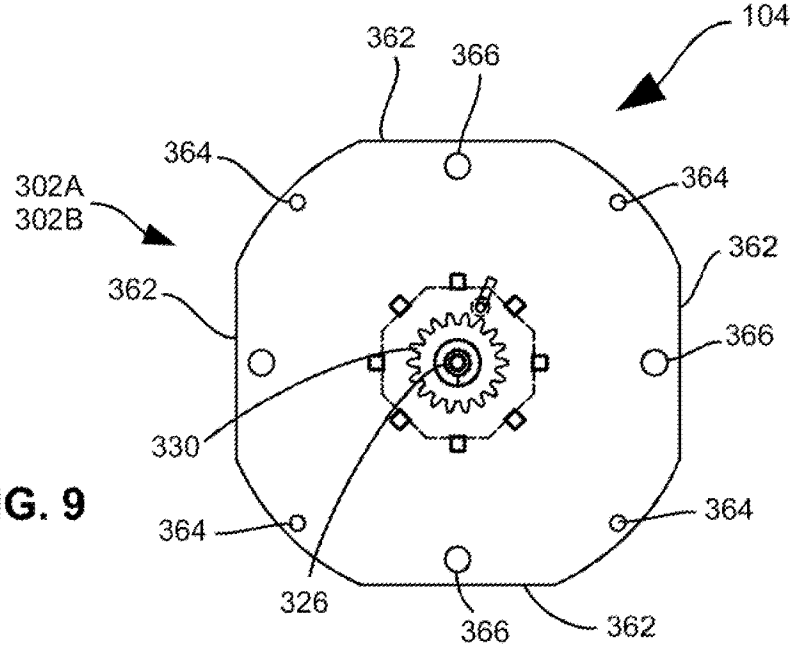
FIG. 9 is a side view of the reel shown in FIG. 6.

As shown in FIG. 9, in this embodiment, each of the sidewalls 302A and 302B is of a round corner square shape having four straight outer edges 362. Each straight outer edge 362 has an angular span of about 45°, that is, the two ends of the straight outer edge 362 are at about 45° with respective to the center of the sidewall 302A, 302B. Corresponding straight outer edges 362 of the sidewalls 302A and 302B are aligned to allow the reel 104 to stably sit on a generally horizontal surface or a ramp.

Each of the side walls 302A and 302B also comprises a set of four mounting holes 364, each proximate a round corner, that is, intermediate the adjacent corners of two adjacent straight outer edges 362. Each of the side walls 302A and 302B further comprises a set of four hanging holes 366 each proximate the center of a straight outer edge 362.

Figure 11B:
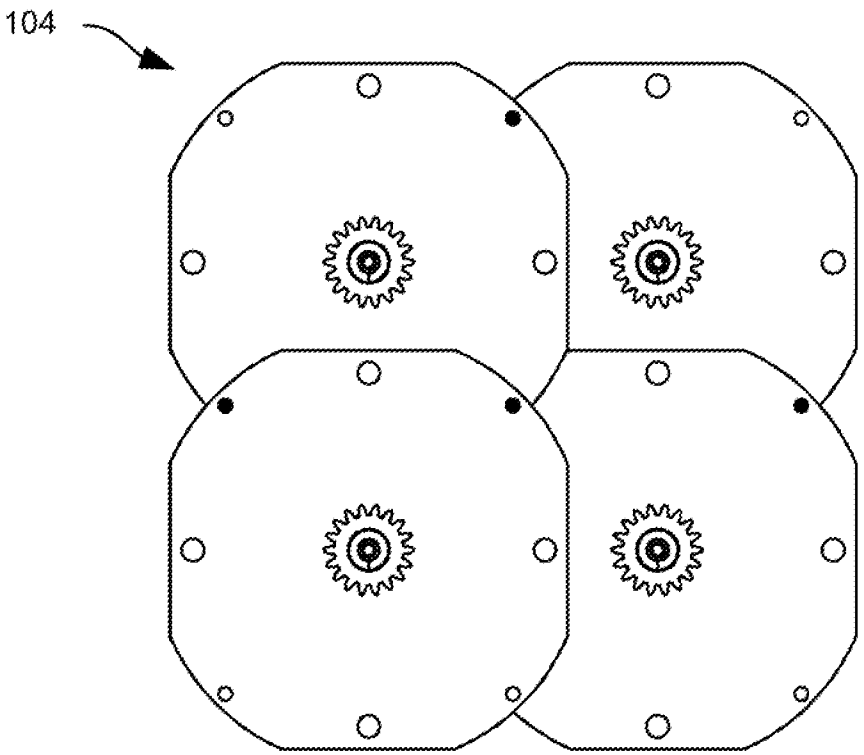
FIG. 11B shows four reels shown in FIG. 6 stacked in a 2-by-2 configuration.
Figure 11A:
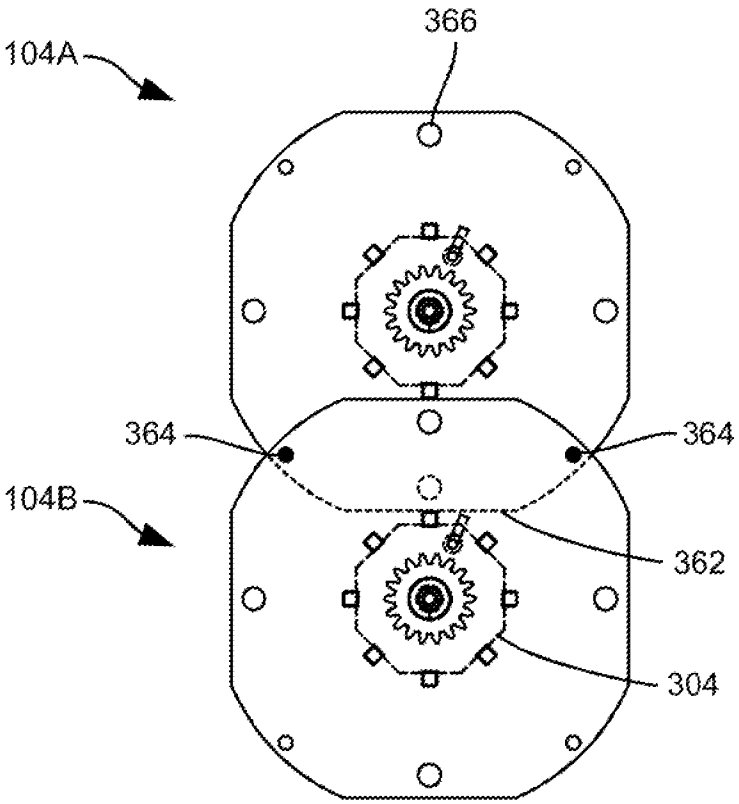
FIG. 11A shows two reels shown in FIG. 6 vertically stacked and mounted together.

The reels 104 disclosed herein may be stacked. As shown in FIG. 11A, two reels 104A and 104B may be vertically stacked by putting reel 104A on top of reel 104B such that the two upper mounting holes 364 of reel 104B are aligned with the two lower mounting holes 364 of reel 104A. Then, bolts are inserted into the aligned mounting holes 364 to tie the two reels 104A and 104B together. The hanging hole 366 on the top edge of the upper reel 104A may be used for hooking and lifting the reels 104A and 104B. FIG. 11B shows four reels 104 are stacked in a 2-by-2 configuration.

Referring again to FIGS. 6 to 9, in this embodiment, the cage 304 has a diameter suitable for winding the hose thereon, and comprises a plurality of supporting pieces 306 made of steel board. The supporting pieces are arranged in parallel and concentric to the sidewalls 302A and 302B. A plurality of lateral members 308 are attached to the supporting pieces 306 along the edges thereof, and extend the full length of the reel 104 to connect the sidewalls 302A and 302B. Thus, the lateral members 308 and supporting pieces 306 form a cage 310. The cage 304 in the example shown in FIGS. 6 and 7 comprises eight (8) lateral members 308.

In this embodiment, at least one lateral member, for example, the lateral member 308A, is laterally discontinuous between two neighboring supporting pieces, for example, the supporting pieces 306A and 306B, to form an entrance 312 to the interior of the cage 310 with a circumferential width sufficient for receiving an end coupling of a hose therein to affix the end coupling of the hose to the reel 104. One or more locking pins 314 may be removably inserted through corresponding holes 316 on the supporting pieces 306A and 306B to laterally traverse and thus "close" the entrance 312 of the cage 304, that is, to reduce the circumferential width such that the end coupling of the hose cannot be removed out of the cage.

The reel 104 also comprises two spindles 324A and 324B laterally outwardly extending from the centers of the sidewalls 302A and 302B, respectively, for the reel 104 to rotate thereabout. Each of the spindles 324A and 324B comprises a pair of delimiters 326 with a width $W_d$ equal to or slightly larger than the thickness of the side frame 126A or 126B of the base framework 106 at the channel 152A or 152B for fitting the spindle 324A or 324B into the channel 152A or 152B. The spindle 324A also comprises a driven sprocket 330 intermediate of the sidewall 302A and the delimiter 326.

The spindles 324A and 324B thus form a discontinuous driven axle 322 of the reel 104. In this embodiment, the spindle 324B also extends laterally inwardly through the center of the sidewall 302B to the supporting piece 306A. The spindle 324A also extends laterally inwardly to the supporting piece 306B adjacent the supporting piece 306A and intermediate the supporting piece 306A and the sidewall 302A, through the centers of the sidewall 302A and the supporting pieces 306 intermediate the sidewall 302A and the supporting piece 306B. Thus in this embodiment, the driven axle 322 formed by the spindles 324A and 324B is laterally discontinuous between the neighboring supporting pieces 306A and 306B to ensure a sufficient interior space of the cage 310 in proximity with the entrance 312.

Figure 10B:
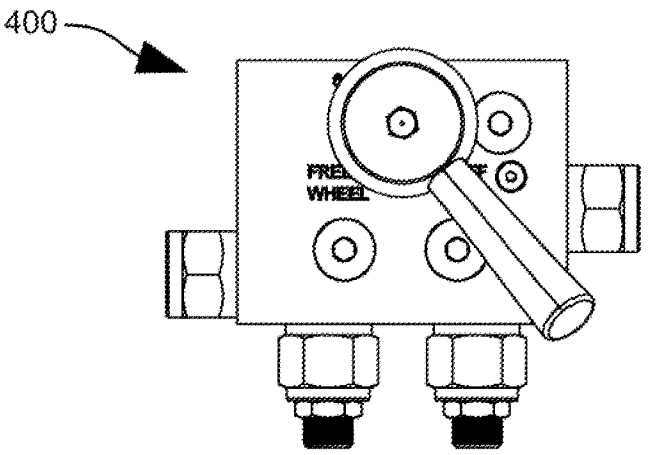
FIG. 10B is a front view of the hydraulic motor component shown in FIG. 10A.
Figure 10C:
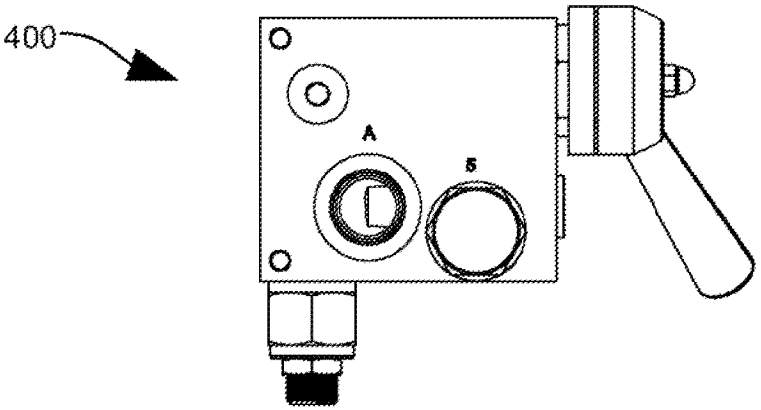
FIG. 10C is a side view of the hydraulic motor component shown in FIG. 10A.
Figure 10A:
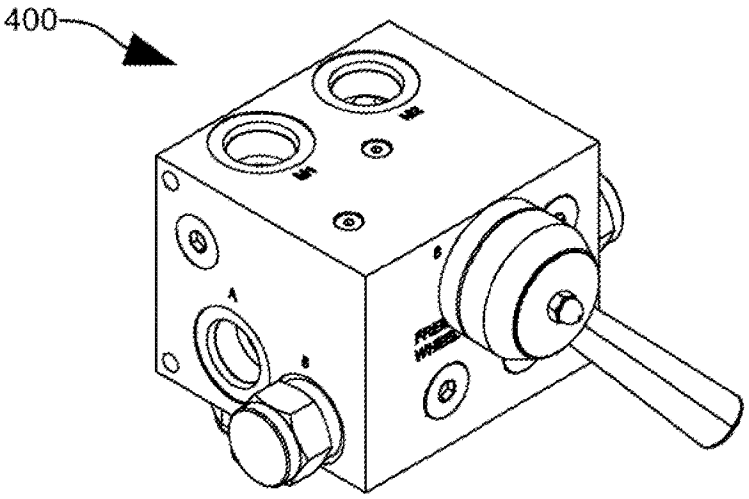
FIG. 10A is a perspective view of a hydraulic motor component of the hose-reeling apparatus shown in FIG. 1.
Figure 10D:
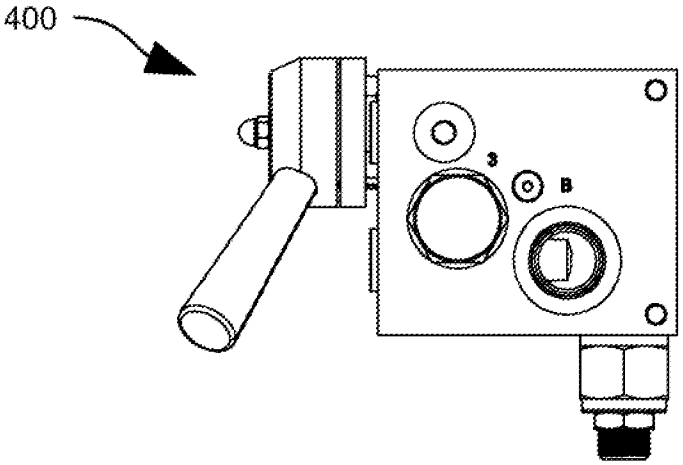
FIG. 10D is a side view of the hydraulic motor component shown in FIG. 10A, showing the opposite side of the hydraulic motor to that shown in FIG. 10C.
Figure 10E:
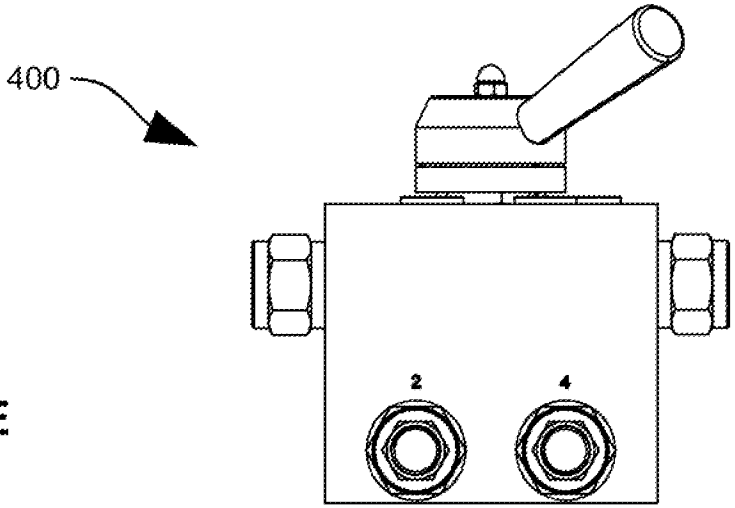
FIG. 10E is a bottom view of the hydraulic motor component shown in FIG. 10A.
Figure 10F:
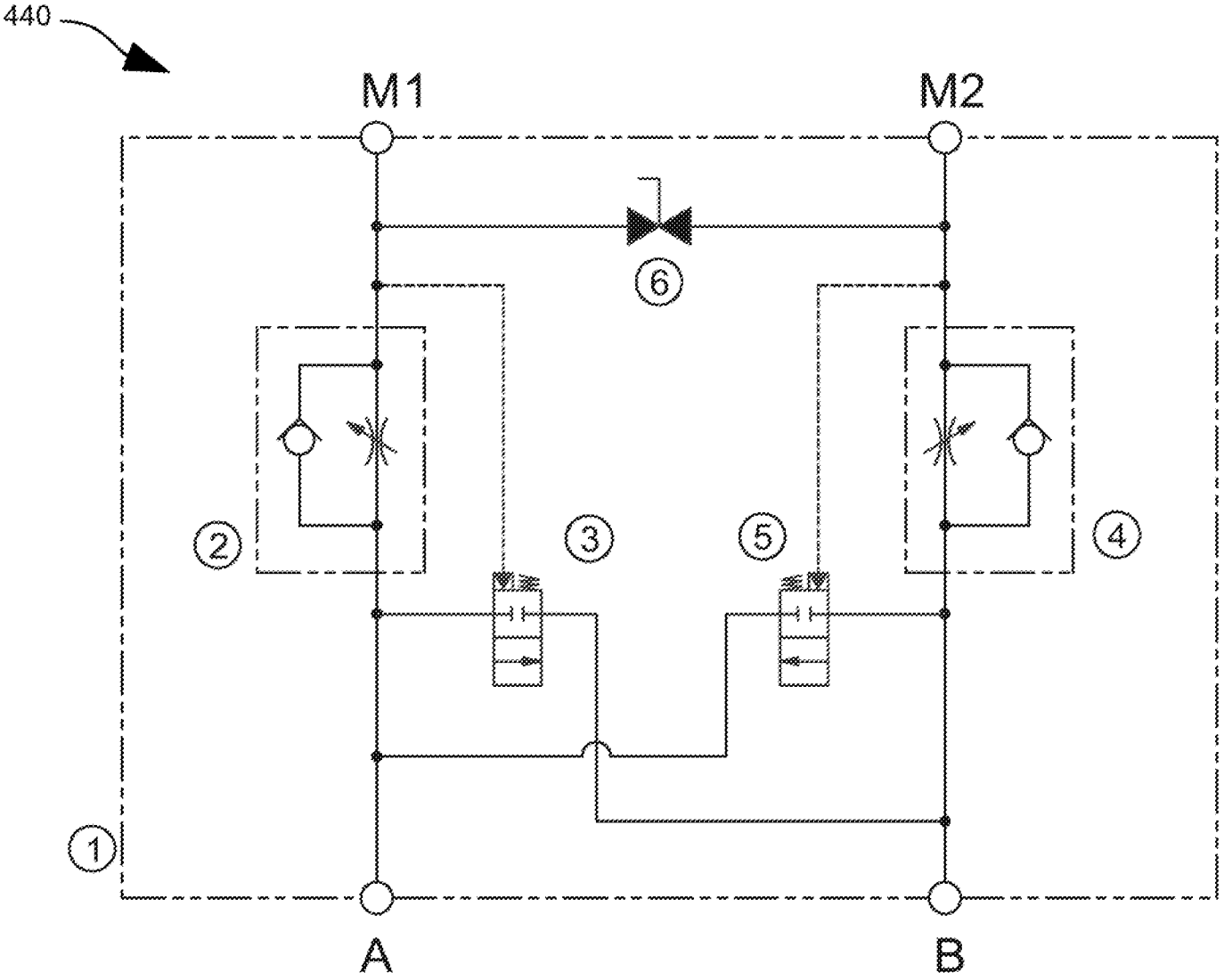
FIG. 10F is the control diagram of the hydraulic motor component shown in FIG. 10A.

The hose-reeling apparatus 100 in this embodiment comprises a hydraulic motor component to drive the reel 104 via the transmission assembly 164. FIGS. 10A to 10E illustrate different view of the hydraulic motor controller 400. FIG. 10F is the control diagram 440 of the hydraulic motor controller 400.

Figure 12:
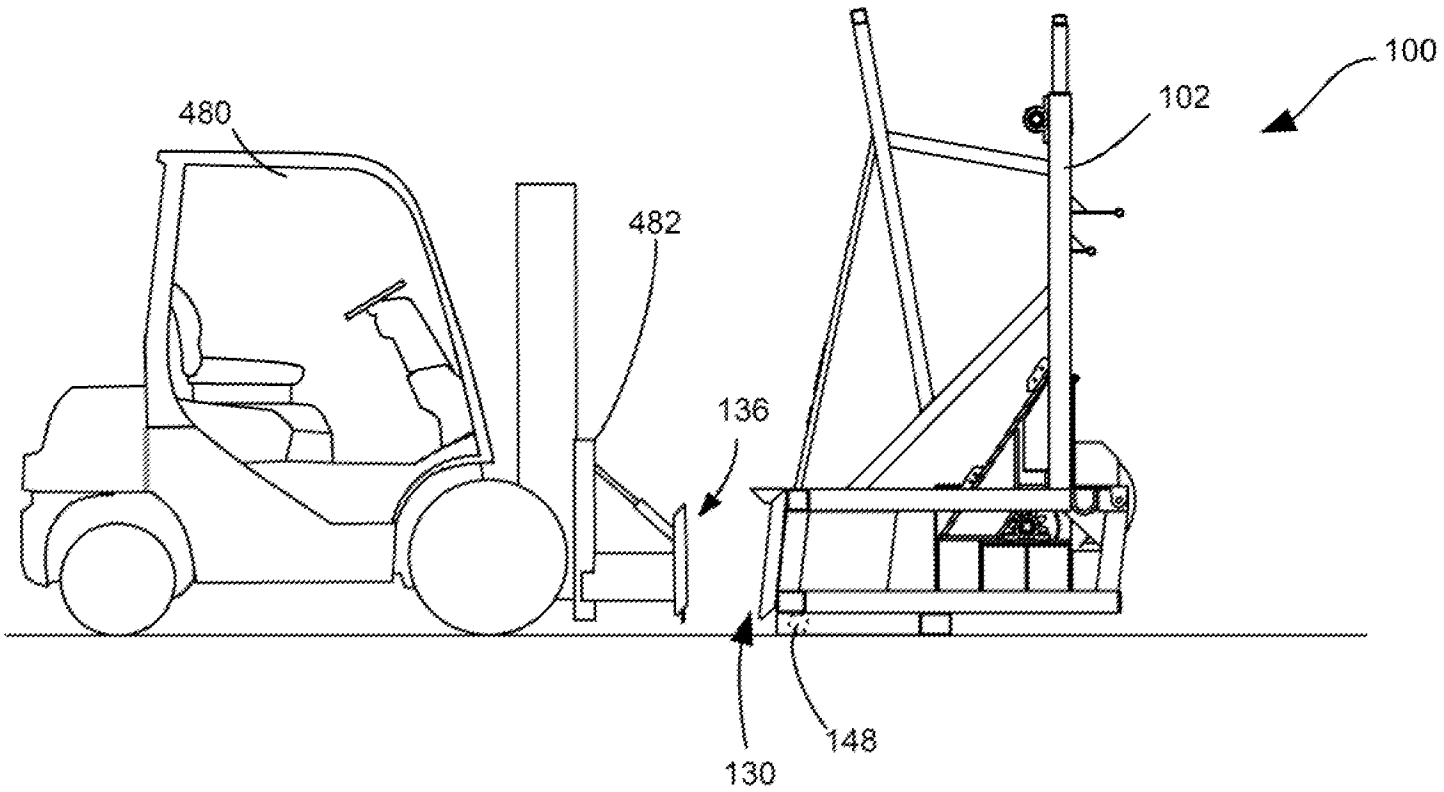
FIG. 12 shows coupling the rack shown in FIG. 3 to a self-propelled equipment.

Referring to FIG. 12, and also referring to FIGS. 2C and 2D, in hose deployment/retrieval, the rack 102 is first coupled to a self-propelled equipment 480. An operator controls the self-propelled equipment 480 to rotate and move the coupling pad 136 to insert the bottom protrusions 138B of the coupling pad 136 into the coupling slots 134B of the coupling structure 130 of the rack 102. Then, the operator controls the self-propelled equipment 480 to rotate and move the coupling pad 136 to insert the top protrusion 138A of the coupling pad 136 into the coupling recess 134A of the coupling structure 130, and finally slightly shift the coupling pad 136 upward to engage the top protrusion 138A with the top wall 132A of the coupling structure 130.

After coupling the rack 102 to the self-propelled equipment 480, a reel 104 is installed to the rack 102. Referring to FIGS. 13A to 13D, the operator first rotates the locking arms 214A and 214B of the rack 102 about the pivots 216A and 216B, respectively, to their unlock positions to expose the channels 152A and 152B. Then, the operator controls the self-propelled equipment 480 to lower the rack 102 such that the channels 152A and 152B are at an elevation lower than the spindles 324A and 324B. The operator then drives the self-propelled equipment 480 towards the reel 104 such that the channels 152A and 152B are aligned with and under the spindles 324A and 324B. The operator then lifts the rack 102 to receive the reel 104 into the front opening 128 thereof, and fits the two spindles 324A and 324B into the channels 152A and 152B, respectively, such that, on each of the spindles 324A and 324B, the delimiters 326 engages the edges of the channel 152A, 152B. The sprocket 330 of the reel 104 therefore engages the first driven sprocket 172 (see FIGS. 2 and 5). The operator then rotates the locking arms 214A and 214B to their lock positions, and secures the locking arms 214A and 214B using securing pins.

Figure 13A:
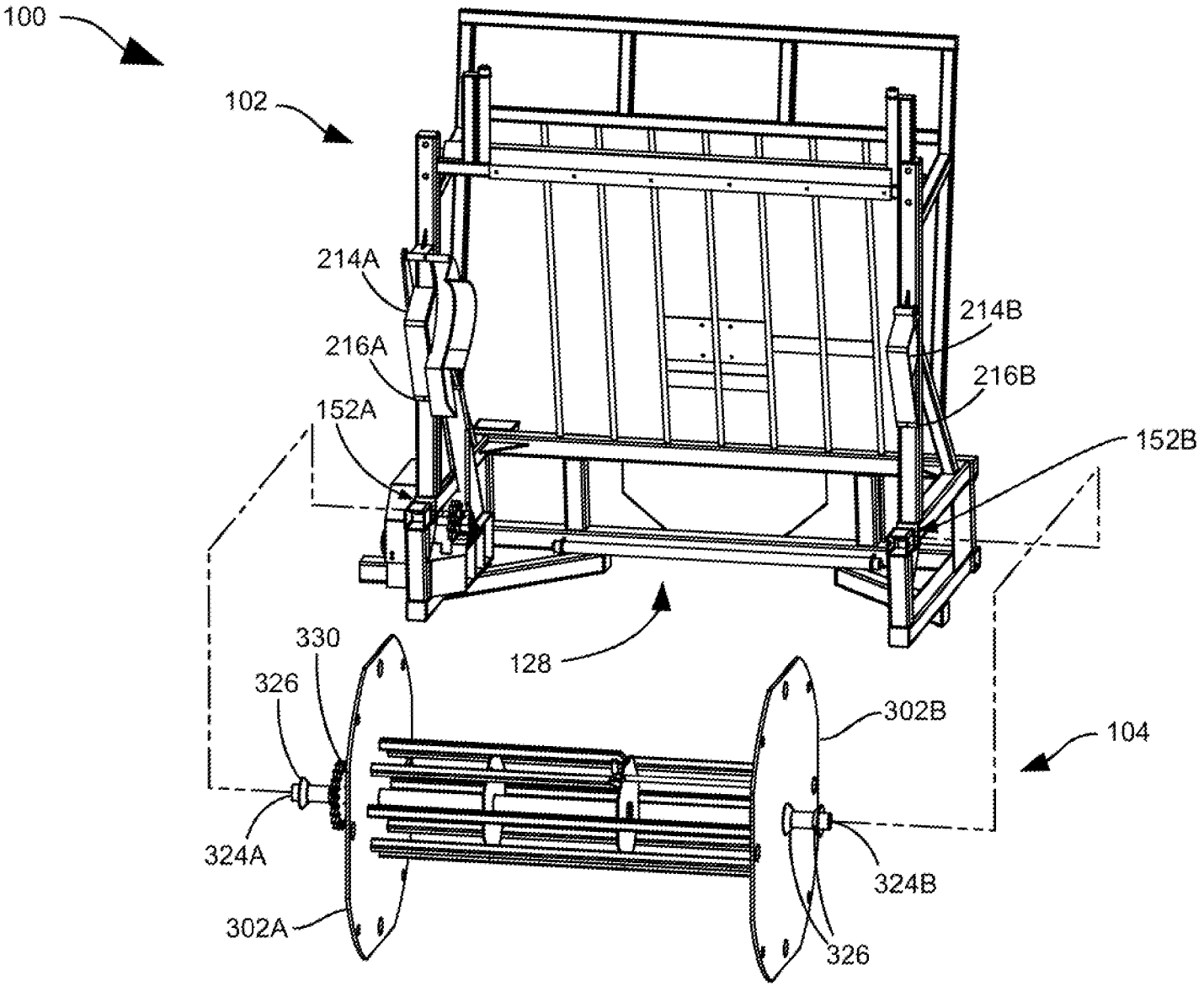
FIGS. 13A and 13B are an exploded view and a side view, respectively, of the hose-reeling apparatus shown in FIG. 1, illustrating installation of the reel shown in FIG. 6 into the rack shown in FIG. 3.
Figure 13B:
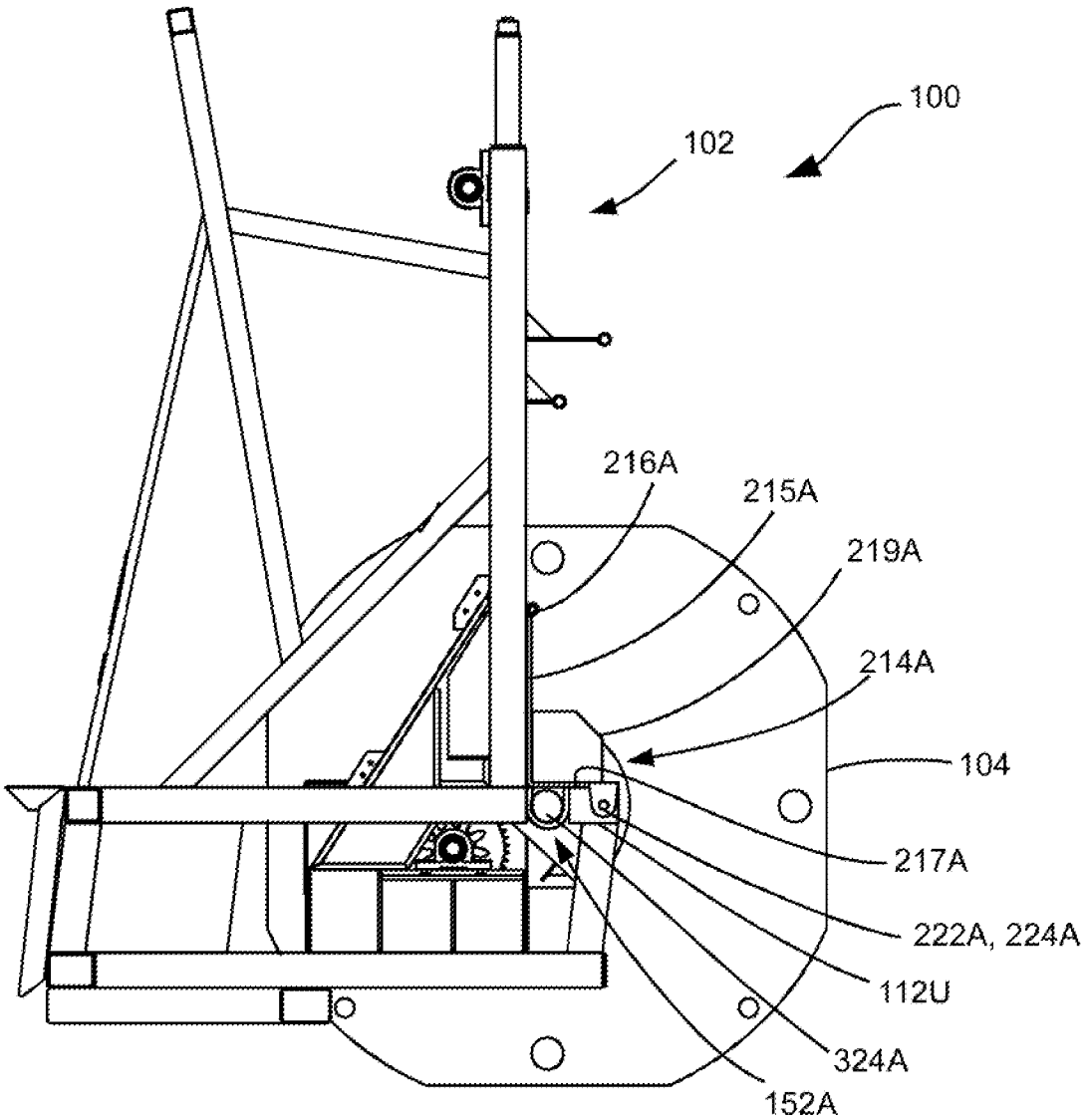
Figure 13C:
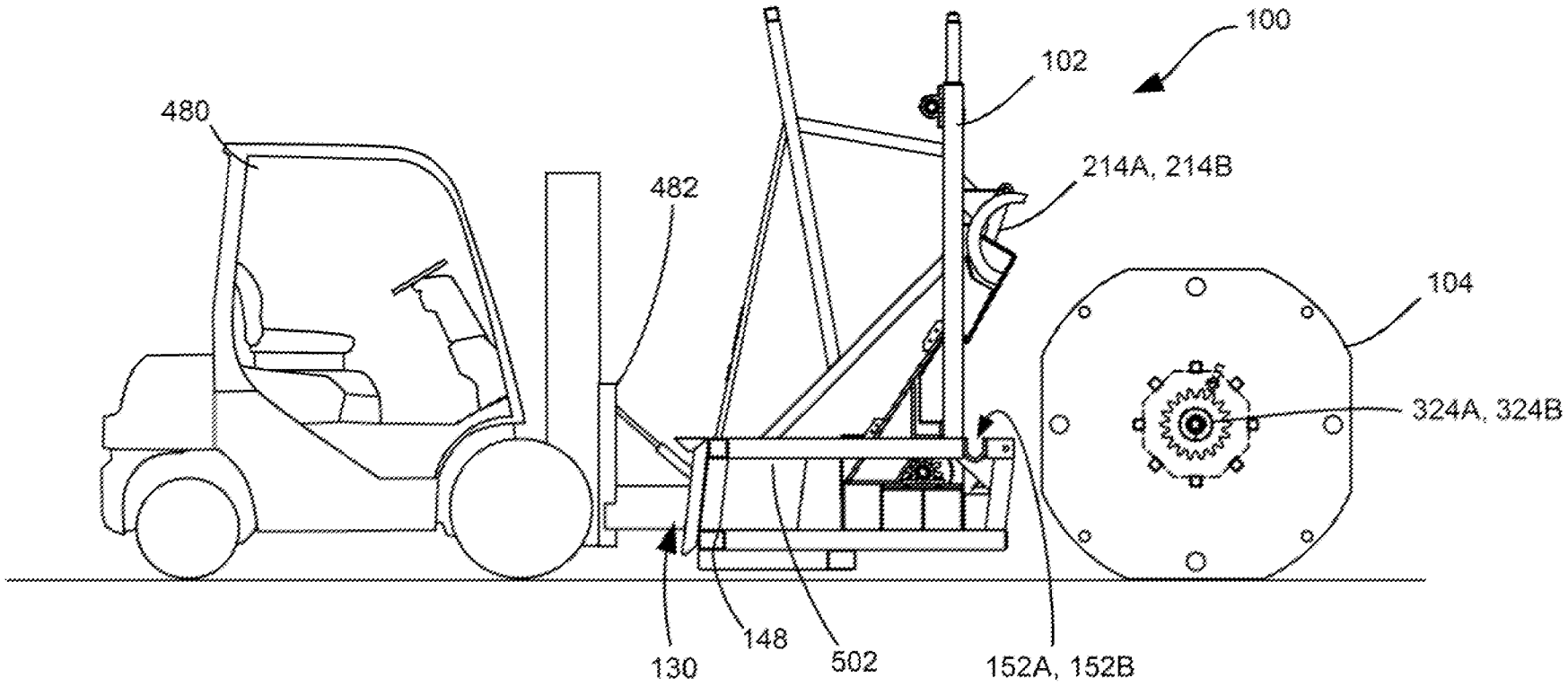
FIG. 13C shows a self-propelled equipment moving the rack shown in FIG. 3 towards the reel shown in FIG. 6, illustrating installation of the reel into the rack.
Figure 13D:
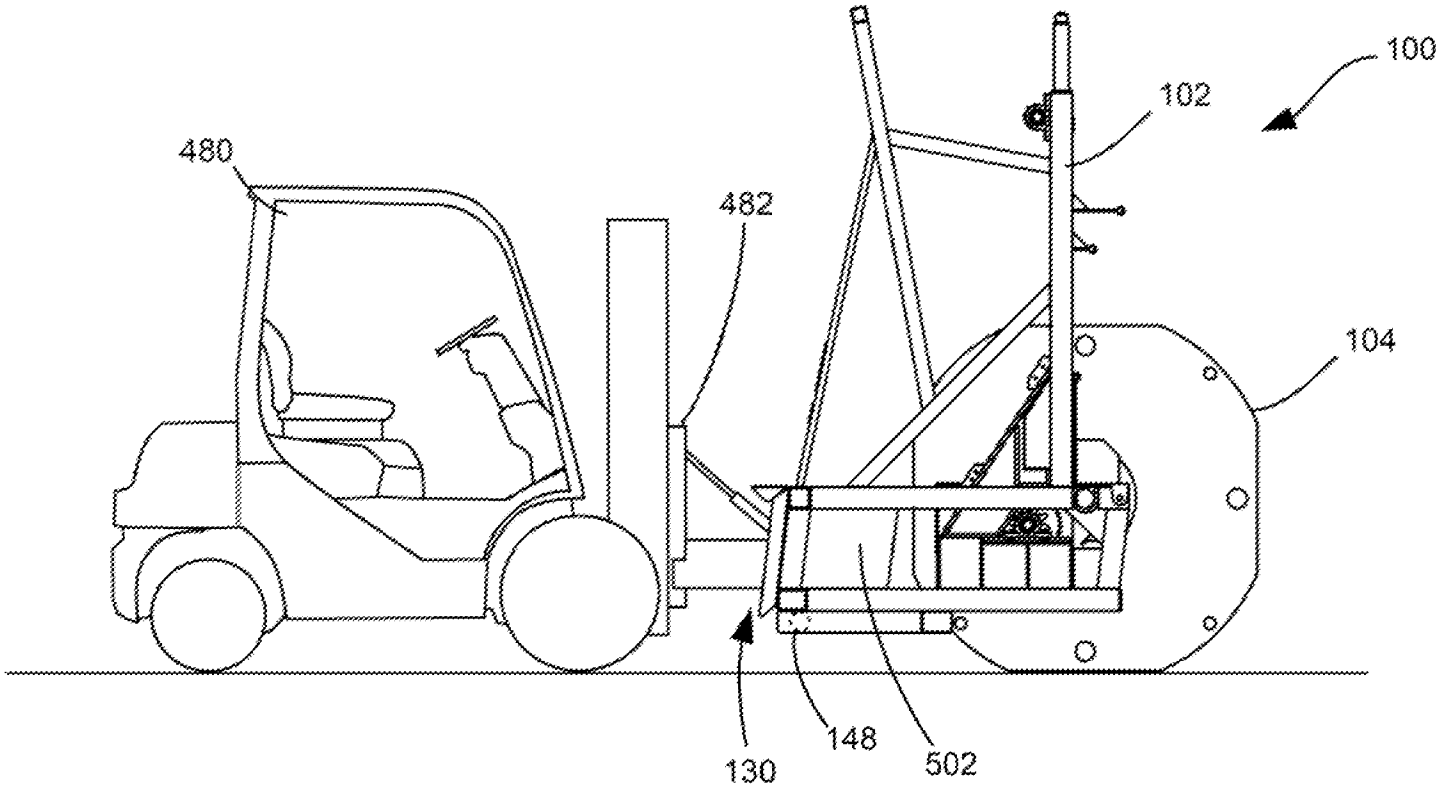
FIG. 13D shows a self-propelled equipment coupled to the rack shown in FIG. 3 with reel shown in FIG. 6 installed on the rack.

As better shown in FIG. 13B, the locking arm 214A (and similarly the locking arm 214B) comprises a proximal portion 215A and a distal portion 217A, configured in an "L" shape, and optionally comprises a reinforcement plate 219A coupled to the proximal and distal portions 215A and 217A. In the lock position, the distal portion 217A of the locking arms 214A engages the upper surface of the upper side rail 112U, cooperating therewith to close the channel 152A, that is, inaccessible from thereabove, locking the spindle 324A of the reel 104 to the rack 102 for use. A securing pin is then inserted through the side-facing pin hole 222A on the locking arm 214A and the corresponding, side-facing pin hole 224A on the upper side rail 112U to secure the locking arm 214A to the upper side rail 112U about the channel 152A.

By using the "L" shaped configuration of the proximal and distal portions 215A and 217A, the reinforcement plate 219A, and the side-facing securing pin engaging side-facing pin holes 222A and 224A, the locking arm 214A provides sufficient strength in securing the (usually heavy) reel 104 in position, and prevents the reel 104 from breaking the locking and jumping off the rack 102 during hose deployment and retrieval operations.

Although not shown, the locking arm 214B has a similar structure, and is also rotated to the lock position to cooperate with the upper side rail 114U to close the channel 152B and lock the spindle 324B in the channel 152B. A securing pin is used to secure the locking arm 214B in position.

After installing the reel 104 into the rack 102, the operator may control the self-propelled equipment to lift the hose-reeling apparatus 100 off the ground for hose deployment and retrieval. FIGS. 14A to 14D show different hose configurations in hose deployment/retrieval operations, according to various embodiments.

Figure 14A:
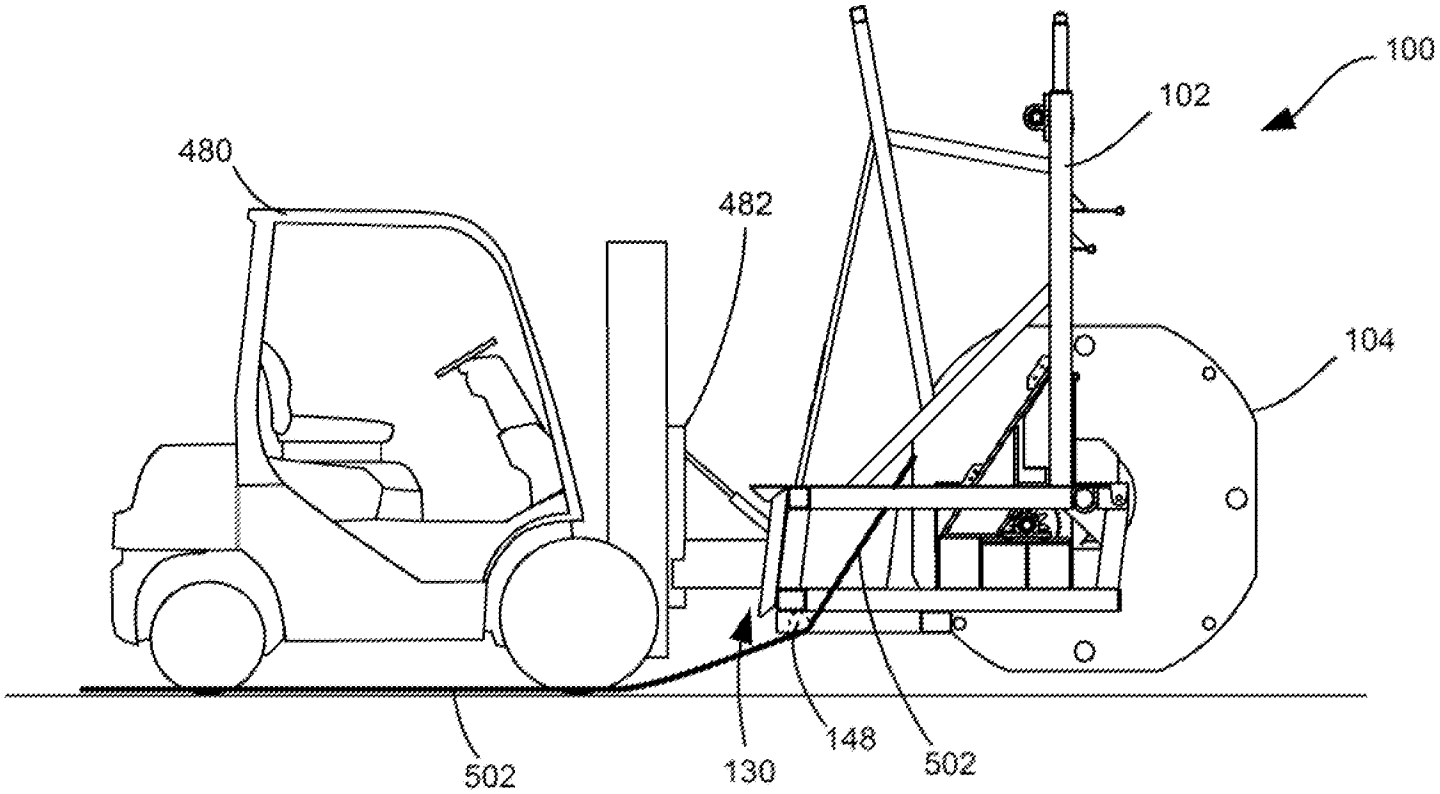
FIGS. 14A to 14D show the deployment/retrieval of a hose using the hose-reeling apparatus shown in FIG. 1, according to various embodiments.

As shown in FIG. 14A, the hose-reeling apparatus 100 may be coupled to an industrial or agricultural vehicle or a self-propelled equipment 480 such as a forklift, a bobcat, a loader, a tractor, a construction vehicle, or the like, by attaching the coupling structure 130 of the rack 102 to a lifting structure 482 of the self-propelled equipment 480. The hose 502 may be backwardly and downwardly extended from the reel 104, wound about the bottom roller 148, and then extended backwardly to a rear side of the self-propelled equipment 480. The self-propelled equipment 480 may move forward along a path for deploying the hose 502, or move backward along a path for retrieving the hose 502.

Figure 14B:
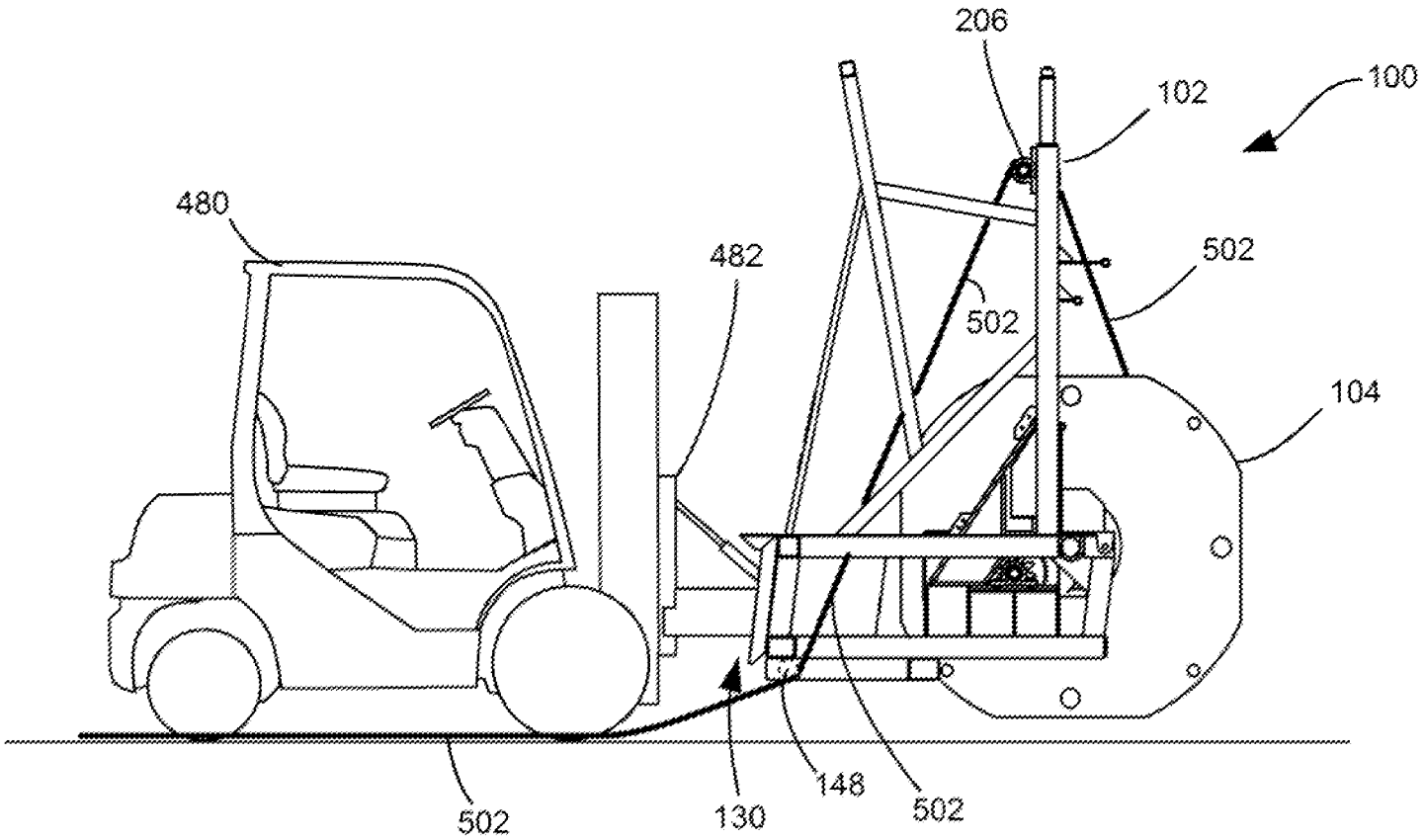

Alternatively, as shown in FIG. 14B, the hose 502 may be backwardly and upwardly extended from the reel 104, wound about the top roller 206, then wound about the bottom roller 148, and extended backwardly to a rear side of the self-propelled equipment 480. The self-propelled equipment 480 may move forward along a path for deploying the hose 502, or move backward along a path for retrieving the hose 502.

Figure 14C:
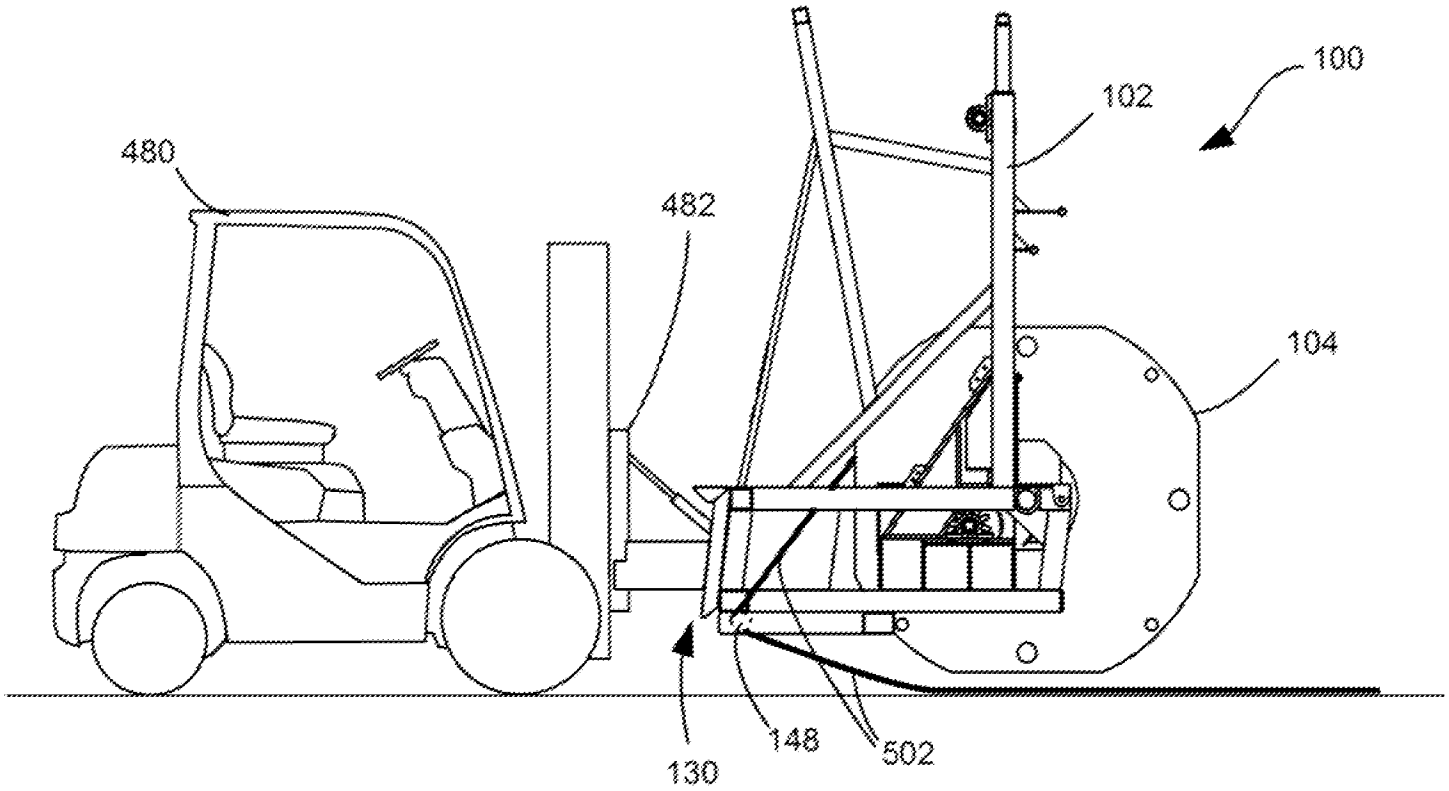

In another embodiment as shown in FIG. 14C, the hose 502 may be backwardly and downwardly extended from the reel 104, wound about the bottom roller 148, and then extended forwardly to a front side of the self-propelled equipment 480. The self-propelled equipment 480 may move backward along a path for deploying the hose 502, or move forward along a path for retrieving the hose 502.

Figure 14D:
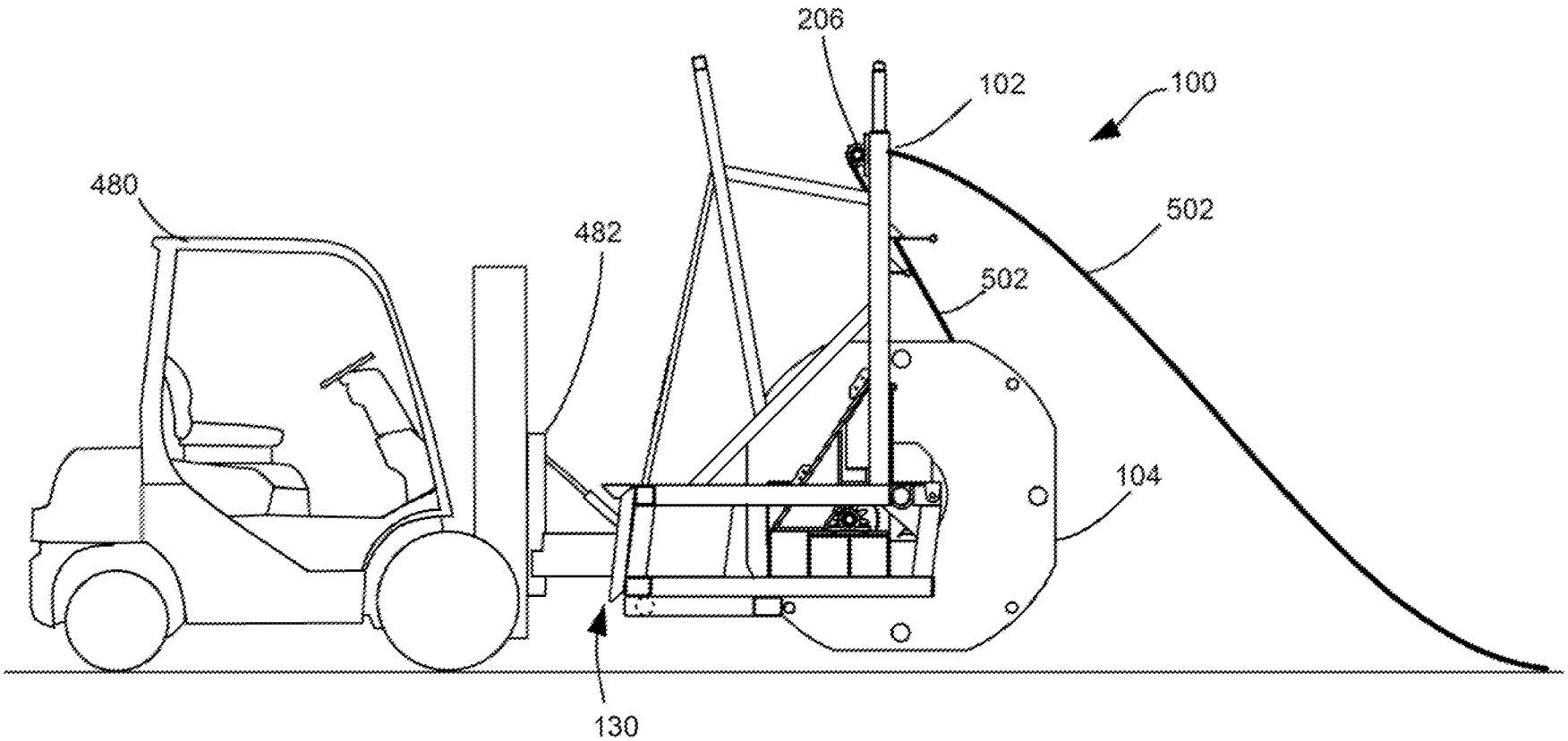

In yet another embodiment as shown in FIG. 14D, the hose 502 may be backwardly and upwardly extended from the reel 104, wound about the top roller 206, and then extended forwardly to a front side of the self-propelled equipment 480. The self-propelled equipment 480 may move backward along a path for deploying the hose 502, or move forward along a path for retrieving the hose 502.

In embodiments shown in FIGS. 14A to 14D, the self-propelled equipment 480 may be alternatively stationary during hose-deployment operations, and the hose 502 may be pulled from a distal end thereof by an operator for deployment. Similarly, the self-propelled equipment 480 may be stationary during hose-retrieval operations, and an operator operates the hydraulic motor component to retrieve the deployed hose.

Those skilled in the art appreciate that various alternative embodiments are readily available. For example, in above embodiments, the top and bottom rollers 206 and 148 are steel rollers. In an alternative embodiment, the rollers 148 and 206 may be rubber coated steel rollers. In another embodiment, the rollers 148 and 206 may be made of other suitable materials such as rubber, hard plastic, and the like.

In above embodiments, the cage 310 comprises an entrance 312 with a large circumferential width. In an alternative embodiment, the cage 310 does not comprise a large-width entrance 312, and thus all lateral members 308 connect the sidewalls 302A and 302B.

Figure 15B:
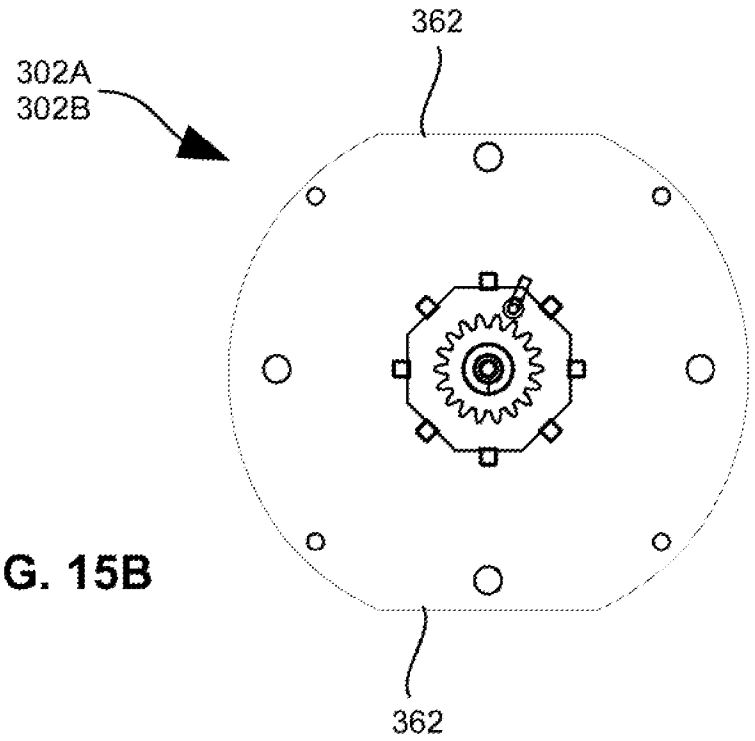
FIGS. 15A to 15G are side views of a reel of the hose-reeling apparatus shown in FIG. 1, according to various alternative embodiments, wherein each of the sidewalls of the reel comprises 1, 2, 3, 4, 5, 6, and 8 general straight outer edges, respectively.
Figure 15A:
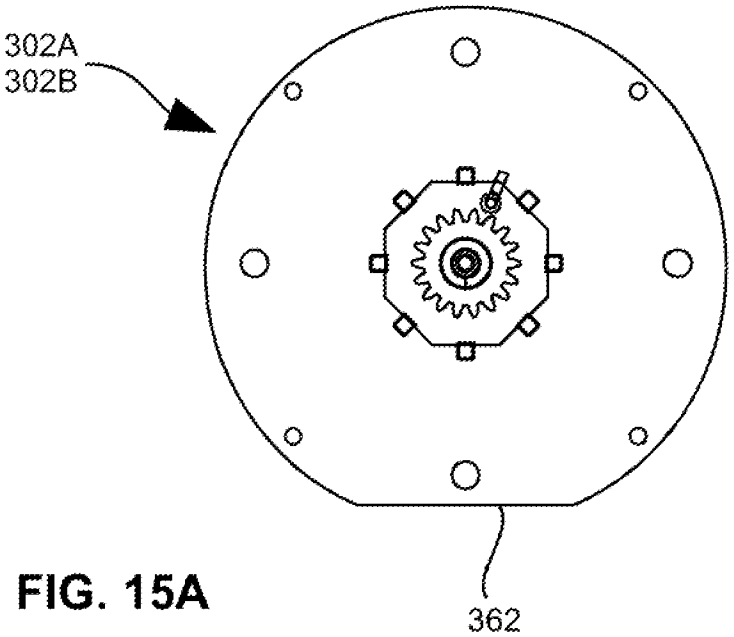
Figure 15C:
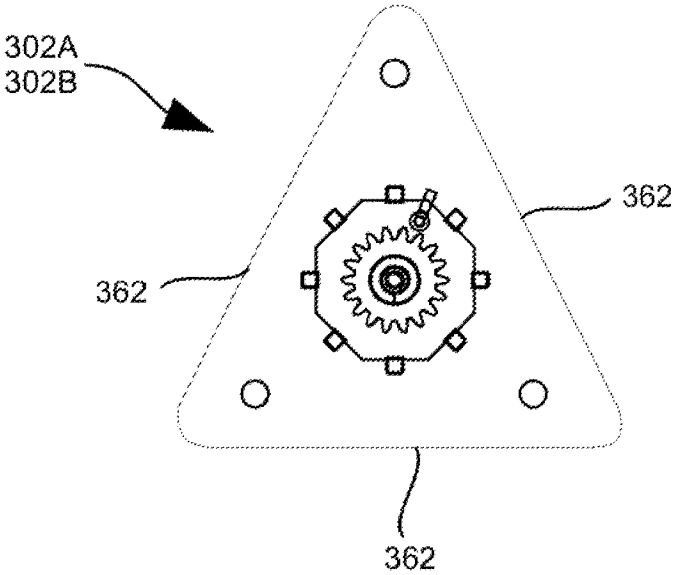
Figure 15D:
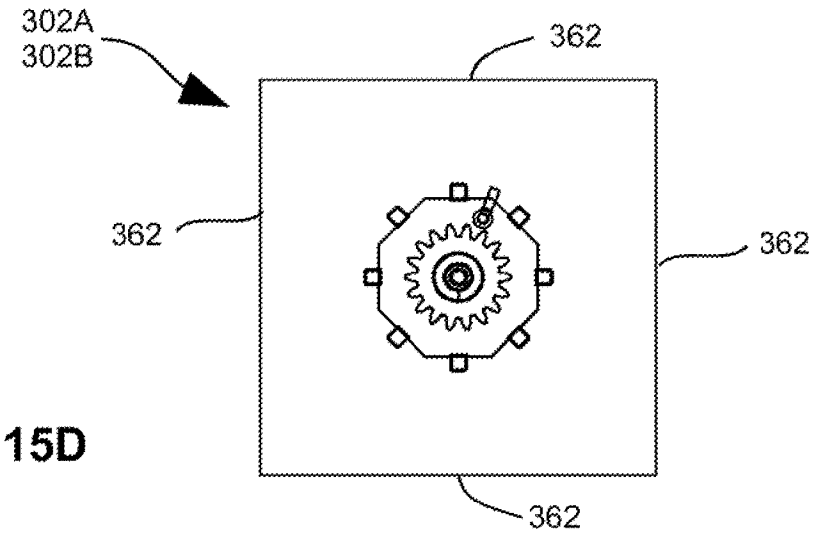
Figure 15E:
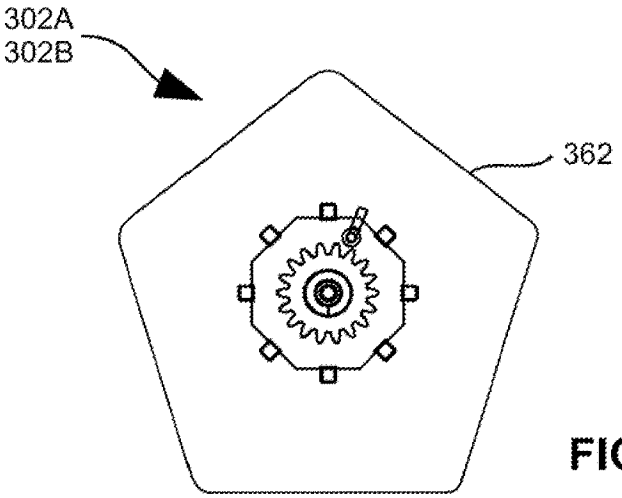
Figure 15F:
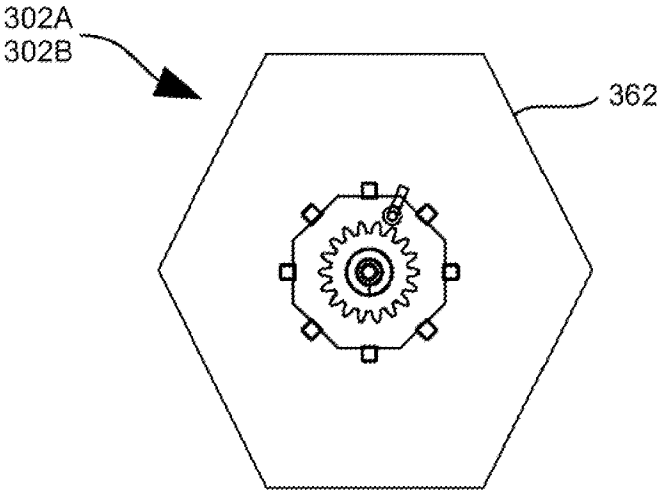
Figure 15G:
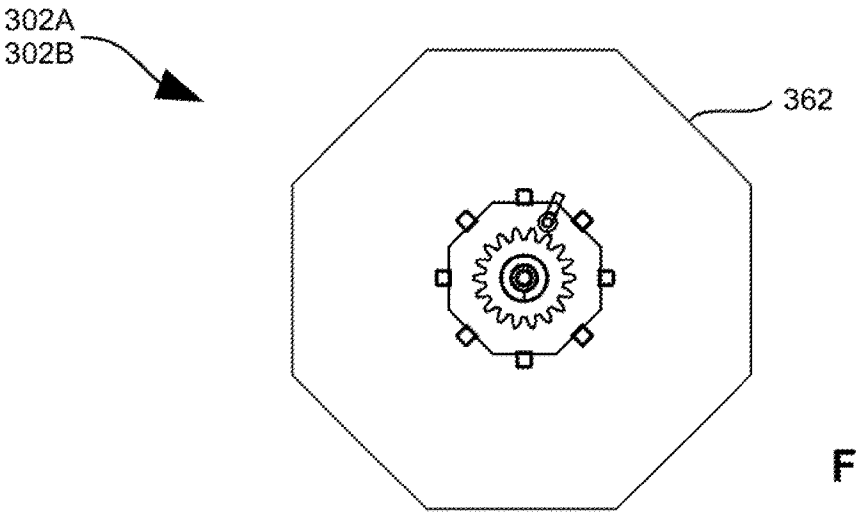

In an alternative embodiment as shown in FIG. 15A, the sidewalls 302A and 302B of the reel 104 only comprises one general straight outer edge 362. In some other embodiments as shown in FIGS. 15B to 15G, the sidewalls 302A and 302B of the reel 104 comprises 2, 3, 4, 5, 6, and 8 general straight outer edges 362, respectively. The corners between adjacent edges are preferably round corners to avoid potential jury to operators during reel rotation.

In an alternative embodiment, the hydraulic motor controller 400 comprises a control circuit (not shown). The control circuit measures the speed of the self-propelled equipment 480, which is also the speed of the rack 102, and calculates and controls the revolution or rotation speed of the reel 104 to synchronize the deployment/retrieval speed of the hose 502 with the speed of the self-propelled equipment 480 to avoid warping or stretching of the hose 502.

In above embodiments, the cage 304 comprises eight (8) lateral members 308. Those skilled in the art appreciate that, in other embodiments, the cage 304 may comprise other suitable numbers of lateral members 308, such as at least four (4), five (5), six (6), or seven (7) lateral members 308. Fewer than four (4) lateral members 308 may cause unsmooth hose deployment/retrieval. However, in some alternative embodiments, the cage 304 may comprise two (2) or three (3) lateral members 308 due to cost considerations. In some other embodiments, the cage 304 may comprise more than eight (8) lateral members 308.

In an alternative embodiment, the two sidewalls 302A and 302B are coupled together by a drum in the form of a hollow cylinder, extending therebetween. In another embodiment, the hollow cylindrical drum comprises a door for receiving an end coupling of the hose.

In an alternative embodiment, the two sidewalls 302A and 302B are coupled together by a drum in the form of a cylinder having a solid core, extending therebetween.

Those skilled in the art appreciate that, the diameter of the cage 304 may be selected based on the flexibility of the hose or pipe to be wound thereon. For flexible hoses, the cage 304 may be of a small diameter.

Figure 16A:
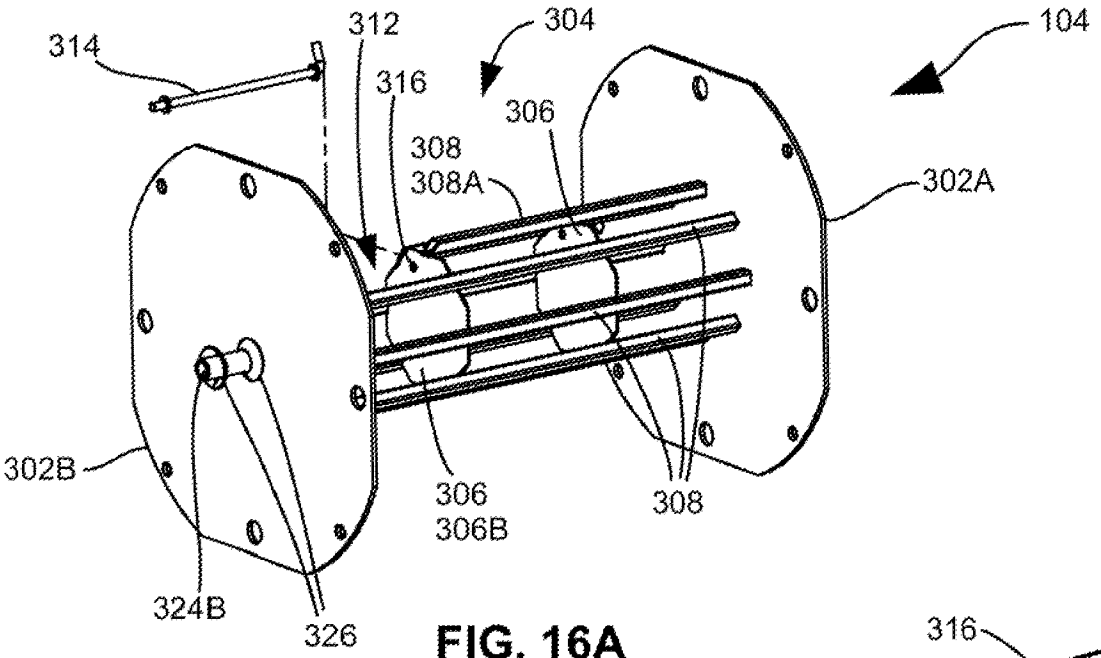
FIGS. 16A and 16B are perspective views of a reel of the hose-reeling apparatus from different viewing angles, according to an alternative embodiment, wherein spindles do not extend inwardly through the respective sidewalls of the reel.
Figure 16B:
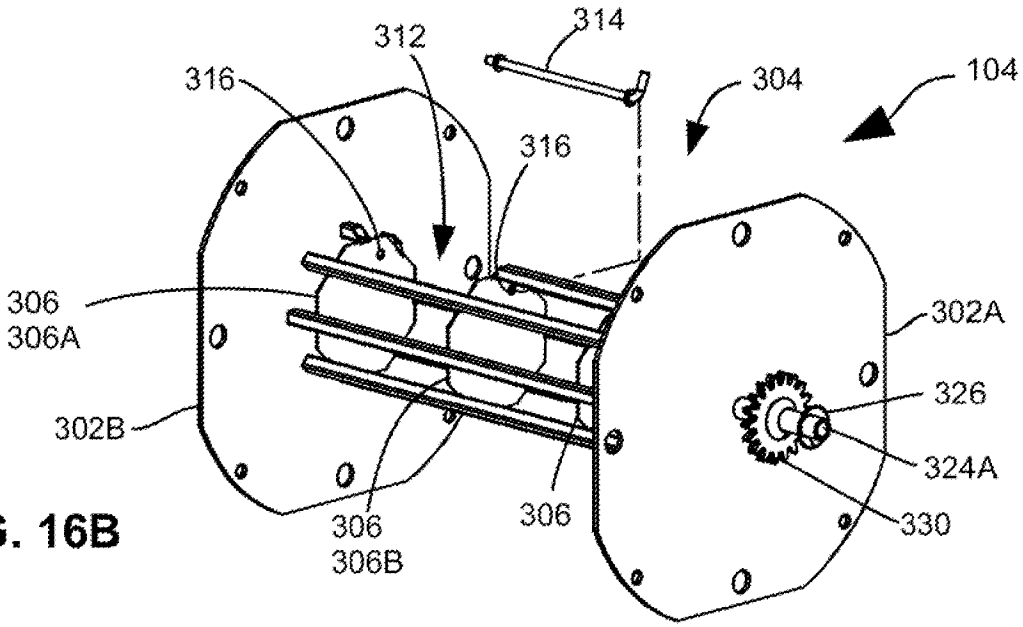

In an alternative embodiment as shown in FIGS. 16A and 16B, the spindles 324A and 324B do not extend inwardly through the respective sidewalls 302A and 302B.

In an alternative embodiment, the driven axle 322 is a continuous axle extending from the spindle 324A to the spindle 324B. In another embodiment that hoses with sufficient flexibility are used, continuous axle may be used for coupling the two sidewalls 302A and 302B, and no cage is used.

Figure 17B:
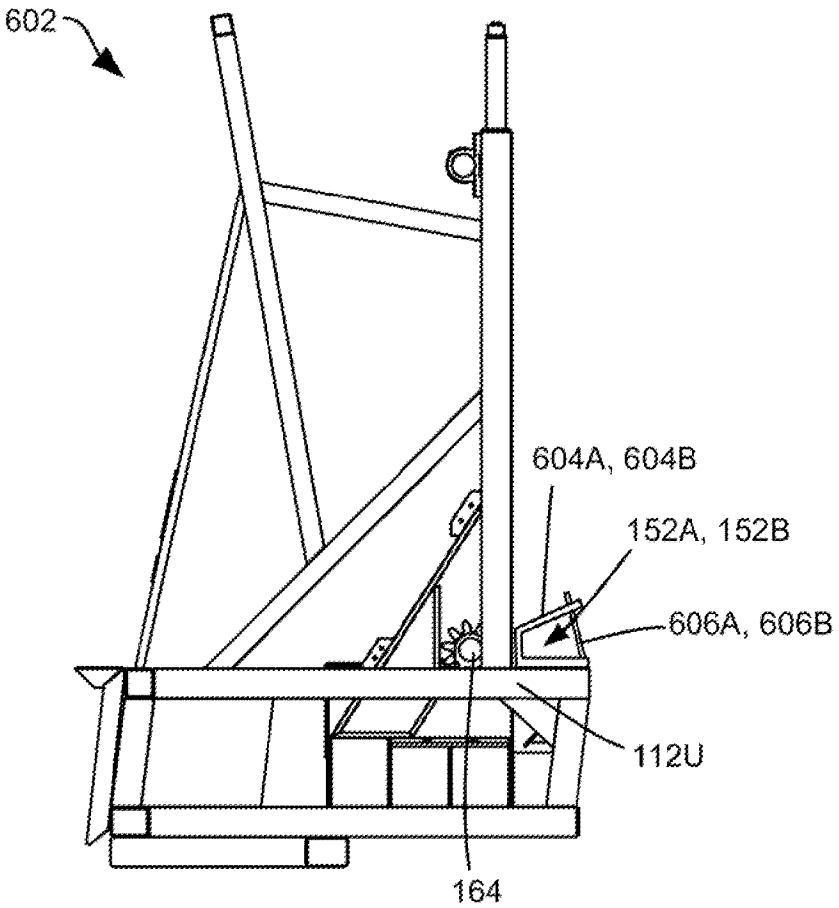
FIG. 17B is a side view of the rack of the hose-reeling apparatus shown in FIG. 17A.
Figure 17A:
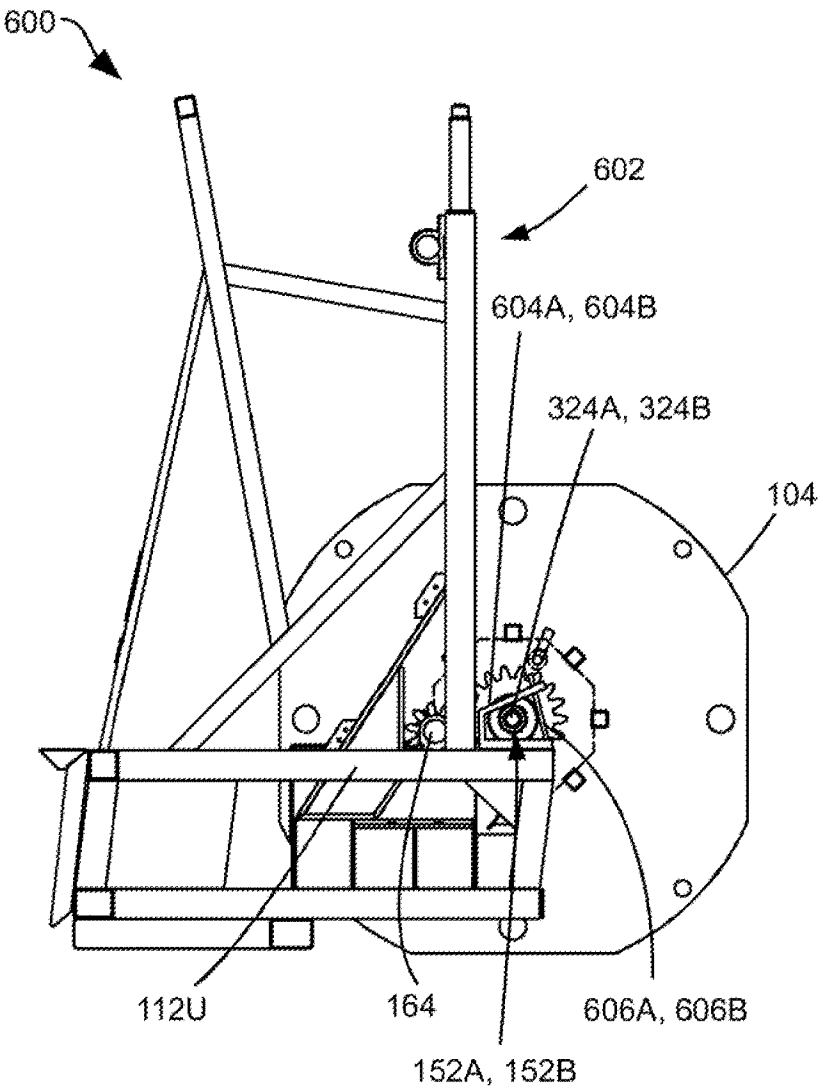
FIG. 17A is a side view of a hose-reeling apparatus comprising a rack and a reel, according to an alternative embodiment of the present disclosure.

FIGS. 17A and 17B show a hose-reeling apparatus 600, according to an alternative embodiment of this disclosure. The hose-reeling apparatus 600 comprises rack 602 and a reel 104. The reel 104 is the same as described above. The rack 602 is the same as the rack 102 described above with a different reel spindle channel configuration.

As shown, in this embodiment, the rack 602 comprises a "U"-shaped bracket 604A, 604B mounted on a front end of the upper side rails 112U, 114U, respectively, and forming a front-facing channel 152A, 152B. When installing a reel 104 into the rack 602, a self-propelled equipment (not shown) may lift the rack 602 such that the front-facing channels 152A and 152B are at the same elevation as the spindles 324A and 324B of the reel 104, and the forwards the rack 604 to slide the spindles 324A and 324B of the reel 104 into the channels 152A and 152B. A securing mechanism, such as a securing pin 606A, 606B, is then inserted into the pin holes (not shown) of the respective bracket 604A, 604B to securely lock the spindles 324A and 324B in the channels 152A and 152B.

In some embodiments, the hose-reeling apparatus 100 does not comprise a hydraulic motor component. Rather, the hose-reeling apparatus 100 comprises a motor component powered by another suitable power source. For example, in one embodiment, the hose-reeling apparatus 100 comprises an electrical motor component.

In an alternative embodiment, the hose-reeling apparatus 100 does not comprise any motor component, nor any transmission assembly. The spindles do not comprise any driven sprockets.

In some embodiments, the spindles 324A and 324B may comprise bearing assemblies (not shown) for fitting into the respective channels 152A and 152B for facilitating reel rotation.

In above embodiments, securing pins are used for removably securing the locking arms 214A and 214B to their locked positions. Those skilled in the art appreciate that, in some alternative embodiments, other suitable securing mechanisms, such as clamps, hooks, latches, bolts, nuts, and the like, may be used for removably securing the locking arms 214A and 214B to their locked positions.

In above embodiments, each of the locking arms 214A and 214B comprises an above-mentioned securing mechanism for securing the respective locking arm 214A, 214B to its locked position. In some alternative embodiments, only one of the locking arms 214A and 214B comprises an above-mentioned securing mechanism. However, the safety of the hose-reeling apparatus 100 in these embodiments may be lower than that in the above embodiments.

Although embodiments have been described above with reference to the accompanying drawings, those of skill in the art will appreciate that variations and modifications may be made without departing from the scope thereof as defined by the appended claims.

What is claimed is:

1. A reel for receiving thereon and deploying therefrom a lay-flat hose, the reel comprising:

two sidewalls; and a cage concentrically coupling the two sidewalls and configured for winding the lay-flat hose thereon, said cage comprising a plurality of circumferentially-spaced lateral members circumferentially distributed about an axis of the cage extending through the sidewalls;

wherein at least one of the plurality of lateral members is laterally discontinuous thereby forming an entrance to the interior of the cage.

2. The reel of claim 1 further comprising:

two or more supporting pieces in the cage for supporting the plurality of lateral members.

3. The reel of claim 2, wherein the at least two of the two or more supporting pieces are at distances from the two sidewalls.

4. The reel of claim 2, wherein the at least one discontinuous lateral member is laterally discontinuous between two neighboring ones of the at least two supporting pieces.

5. The reel of claim 1 further comprising one or more locking pins for removably and laterally traversing the entrance to reduce the circumferential width of the entrance.

6. The reel of claim 5, wherein the one or more locking pins have a L-shape.

7. The reel of claim 5 further comprising:

two or more supporting pieces in the cage for supporting the plurality of lateral members; and wherein the one or more locking pins are removably insertable through the two supporting pieces for laterally traversing the entrance to reduce the circumferential width of the entrance.

* * * * *